US007197790B1

(12) United States Patent
Edmondson

(10) Patent No.: US 7,197,790 B1
(45) Date of Patent: Apr. 3, 2007

(54) HINGE INCLUDING A GAS STRUT

(75) Inventor: Paul Charles Edmondson, Poole (GB)

(73) Assignee: PE Marine Designz, Ltd (GB)

( * ) Notice: Subject to any disclaimer, the term of this patent is extended or adjusted under 35 U.S.C. 154(b) by 0 days.

(21) Appl. No.: 10/921,610

(22) Filed: Aug. 18, 2004

(51) Int. Cl.
*E05D 11/10* (2006.01)
*E05F 1/08* (2006.01)

(52) U.S. Cl. ..... 16/336; 16/366; 16/370; 16/286; 16/288

(58) Field of Classification Search ..... 16/336, 16/366, 368, 369, 370, 286, 50, 54, 238; 49/397, 398; 312/326–327; 37/231, 232, 37/234, 417; 172/272, 810, 811, 677, 679, 172/684.5

See application file for complete search history.

(56) References Cited

U.S. PATENT DOCUMENTS 1,496,965 A * 6/1924 Aldeen ..... 217/60 G
2,135,280 A * 11/1938 Erickson ..... 16/369
2,674,761 A * 4/1954 Weiss ..... 16/288
3,001,224 A * 9/1961 Soss ..... 16/276
3,363,281 A * 1/1968 Borsani ..... 16/288
4,376,340 A * 3/1983 Ramun et al. ..... 30/134
4,479,622 A * 10/1984 Howse ..... 244/129.5
4,583,906 A * 4/1986 Frisbee ..... 414/686
4,669,147 A * 6/1987 Suchanek ..... 16/52
4,817,241 A * 4/1989 Koch et al. ..... 16/238
4,899,420 A * 2/1990 Bye et al. ..... 16/16
5,058,238 A * 10/1991 Lautenschlager ..... 16/278
5,103,532 A * 4/1992 Youngdale et al. ..... 16/288
5,437,079 A * 8/1995 Park ..... 16/54
5,626,194 A * 5/1997 White ..... 169/24
5,682,311 A * 10/1997 Clark ..... 701/50
5,882,099 A * 3/1999 Salice ..... 312/328
6,045,204 A * 4/2000 Frazier et al. ..... 312/247
6,243,918 B1 * 6/2001 Zetti ..... 16/298
6,308,376 B1 * 10/2001 Koshikawa ..... 16/250
6,367,123 B1 * 4/2002 Cheal et al. ..... 16/370
6,382,700 B2 * 5/2002 Young et al. ..... 296/100.1
6,397,434 B1 * 6/2002 Cheal et al. ..... 16/370
6,402,270 B1 * 6/2002 Frank ..... 312/138.1
6,643,577 B1 * 11/2003 Padgett et al. ..... 701/50
2005/0204511 A1 * 9/2005 Wohlfarth ..... 16/367

FOREIGN PATENT DOCUMENTS

DE 3234752 A1 * 3/1984
DE 29802043 U1 * 6/1998
DE 10222987 A1 * 12/2003
EP 670283 A1 * 9/1995
EP 846815 A2 * 6/1998

* cited by examiner

*Primary Examiner*—Chuck Y. Mah
(74) *Attorney, Agent, or Firm*—Blakely, Sokoloff, Taylor & Zafman, LLP

(57) ABSTRACT

A hinge which includes a gas strut. The hinge in one embodiment further includes a first control arm and a second control arm which is coupled to the first control arm. The gas strut in this one embodiment is coupled to both first and second control arms.

28 Claims, 21 Drawing Sheets

SECTION F-F

SECTION H-H

SECTION G-G

HINGE INCLUDING A GAS STRUT

BACKGROUND

The present invention relates to a hinge including a gas strut. Preferably, the present invention relates to hinge having a gas strut integrally formed with the hinge. More preferably, the present invention relates to hinge having a gas strut positioned within the working envelope of the hinge.

It is known in the art, that a gas strut can be used in combination with a hinge in order to aid with the opening of doors. In particular, it is known in the field of car boot doors to use a gas strut in combination with a hinge.

European Patent Publication No. 0808982 discloses a multi-link hinge wherein a gas strut acts on the hinge in order to assist in the opening of a car boot. FIG. 13 illustrates this conventional hinge. The hinge comprises a fixed member 1 attached to a car body, a moveable member 2 attached to the lid of a boot, an inner link 3, an outer link 4, a pivotal lever 5, a cam 6 and a gas strut 7. The inner and outer links 3, 4 pivot the moveable member 2 about the fixed member 1. The pivotal lever 5 is attached to the moveable member 2 and the cam 6 is attached to the fixed member 1, such that one end of the pivotal lever 5 comprises a roller cam follower 8 which engages the cam 6. The other end of the pivotal lever is attached to the gas strut 7. The gas strut 7 is also pivotally attached to the fixed member 2, such that when the boot is opened, the gas strut 7 is pivoted about the pivotal lever 5.

In common with other prior art designs, this hinge takes up a considerable amount of space when compared with hinges which do not use gas struts. Additionally, this type of hinge is unsightly and it is easy for users to trap fingers in the hinge, or snag clothing on the hinge. The fact that the hinges are unsightly and it is easy for users to trap fingers or clothing, means that this type of hinge does not tend to be used in doors having an axis of rotation that is vertical.

SUMMARY

Consequently, the hinge of the present invention has been devised in order to overcome the above mentioned disadvantages.

In a first embodiment of the present invention, the hinge comprises a first control arm having a first end and a second end; a second control arm having a first end and a second end, said first control arm and said second control arm being pivotally connected to each other at a first point between said first and second ends of said first control arm and said first and second ends of said second control arm; and a gas strut having a first end and a second end, said first end of said gas strut being pivotally connected to said first control arm at either said first end of said first control arm or a second point between said first end of said first control arm and said first point, and said second end of said gas strut being pivotally connected to said second control arm at either said first end of said second control arm or a third point between said first end of said second control arm and said first point.

In a second embodiment of the present invention, the hinge further comprises a first support arm having a first end and a second end, said first end of said first support arm being pivotally connected to said first end of said first control arm; and a second support arm having a first end and a second end, said first end of said second support arm being pivotally connected to said first end of said second control arm.

In a third embodiment of the present invention, the hinge further comprises a third control arm having a first end and a second end; and a fourth control arm having a first end and a second end, said third control arm and said fourth control arm being pivotally connected to each other at a fourth point between said first and second ends of said third control arm and said first and second ends of said fourth control arm; wherein said first end of said gas strut is pivotally connected to said third control arm at either said first end of said third control arm or a fifth point between said first end of said third control arm and said fourth point, and said second end of said gas strut is pivotally connected to said fourth control arm at either said first end of said fourth control arm or a sixth point between said first end of said fourth control arm and said fourth point, such that said gas strut is positioned between a first layer comprising said first and second control arms and a second layer, comprising said third and fourth control arms.

In a fourth embodiment of the present invention, the hinge further comprises a first support arm having a first end and a second end, said first end of first support arm being pivotally connected to said first end of said first control arm; a second support arm having a first end and a second end, said first end of second support arm being pivotally connected to said first end of said second control arm; a third control arm having a first end and a second end; a fourth control arm having a first end and a second end, said third control arm and said fourth control arm being pivotally connected to each other at a fourth point between said first and second ends of said third control arm and said first and second ends of said fourth control arm; a third support arm having a first end and a second end, said first end of said third support arm being pivotally connected to said first end of said third control arm; and a fourth support arm having a first end and a second end, said first end of said fourth support arm being pivotally connected to said first end of said fourth control arm; wherein said first end of said gas strut is pivotally connected to said third control arm at either said first end of said third control arm or a fifth point between said first end of said third control arm and said fourth point, and said second end of said gas strut is pivotally connected to said fourth control arm at either said first end of said fourth control arm or a sixth point between said first end of said fourth control arm and said fourth point, such that said gas strut is positioned between a first layer comprising said first and second control arms and a second layer, comprising said third and fourth control arms.

In a fifth embodiment of the present invention, the gas strut is positioned within the working envelope of said hinge.

In a sixth embodiment of the present invention, the first and second control arms are straight members.

In a seventh embodiment of the present invention, the first and second control arms are hook shaped at said second end.

In an eighth embodiment of the present invention, the first, second, third and fourth control arms are straight members.

In a ninth embodiment of the present invention, the first, second, third and fourth control arms are hook shaped at said second end.

In a tenth embodiment of the present invention, the gas strut comprises a cylinder and a piston, and said piston is recessed within said cylinder when said hinge is closed.

In an eleventh embodiment of the present invention, the gas strut comprises a cylinder and a piston, and said piston projects from said cylinder when said hinge is open.

In a twelfth embodiment of the present invention, the hinge is held closed by a locking means.

In a thirteenth embodiment of the present invention, the hinge is held closed by a locking means, and wherein when said locking means is released, said gas strut opens said hinge.

In a fourteenth embodiment of the present invention, the second end of said first control arm is capable of being attached to a first member and said second end of said second control arm is capable of being attached to a second member, said hinge enabling said first member to move in relation to said second member.

In a fifteenth embodiment of the present invention, the second end of said first control arm and said second end of said first support arm are capable of being attached to a first member, and said second end of said second control arm and said second end of said second support arm are capable of being attached to a second member, said hinge enabling said first member to move in relation to said second member.

In a sixteenth embodiment of the present invention, the second end of said first control arm is capable of being attached to a first mounting block and said second end of said second control arm is capable of being attached to a second mounting block, said first mounting block being capable of being attached to a first member and said second mounting block being capable of being attached to a second member, and said hinge enabling said first member to move in relation to said second member.

In a seventeenth embodiment of the present invention, the second end of said first control arm and said second end of said first support arm are capable of being attached to a first mounting block, and said second end of said second control arm and said second end of said second support arm are capable of being attached to a second mounting block, said first mounting block being capable of being attached to a first member and said second mounting block being capable of being attached to a second member, and said hinge enabling said first member to move in relation to said second member.

In an eighteenth embodiment of the present invention, the second end of said first control arm and said second end of said third control arm are capable of being attached to a first member, and said second end of said second control arm and said second end of said fourth control arm are capable of being attached to a second member, and said hinge enabling said first member to move in relation to said second member.

In a nineteenth embodiment of the present invention, the second end of said first control arm, said second end of said first support arm, said second end of said third control arm and said second end of said third support arm are capable of being attached to a first member, and said second end of said second control arm, said second end of said second support arm, said second end of said fourth control arm, said second end of said fourth support arm are capable of being attached to a second member, and said hinge enabling said first member to move in relation to said second member.

In a twentieth embodiment of the present invention, the second end of said first control arm and said second end of said third control arm are capable of being attached to a mounting block, and said second end of said second control arm and said second end of said fourth control arm are capable of being attached to a second mounting block, said first mounting block being capable of being attached to a first member and said second mounting block being capable of being attached to a second member, and said hinge enabling said first member to move in relation to said second member.

In a twenty-first embodiment of the present invention, the second end of said first control arm, said second end of said first support arm, said second end of said third control arm and said second end of said third support arm are capable of being attached to a first mounting block, and said second end of said second control arm, said second end of said second support arm, said second end of said fourth control arm and said second end of said fourth support arm are capable of being attached to a second mounting block, said first mounting block being capable of being attached to a first member and said second mounting block being capable of being attached to a second member, and said hinge enabling said first member to move in relation to said second member.

In a twenty-second embodiment of the present invention, the gas strut is connected to said first control arm by a first connection member and said second control arm by a second connection member.

In a twenty-third embodiment of the present invention, the gas strut is connected to said first and third control arms by a first connection member and said second and fourth control arms by a second connection member.

In a twenty-fourth embodiment of the present invention, the gas strut is a push-type gas strut.

In a twenty-fifth embodiment of the present invention, the gas strut is a pull-type gas strut.

In a twenty-sixth embodiment of the present invention, the hinge is held open by a locking means.

In a twenty-seventh embodiment of the present invention, the hinge is held open by a locking means, and wherein when said locking means is released, said gas strut closes said hinge.

In a twenty-eighth embodiment of the present invention, the gas strut is connected to said first control arm by a first connection member and said second control arm by a second connection member and wherein said gas strut can be disconnected from said first and second connection members and said gas strut replaced by a new gas strut.

In a twenty-ninth embodiment of the present invention, the gas strut is connected to said first and third control arms by a first connection member and said second and fourth control arms by a second connection member and wherein said gas strut can be disconnected from said first and second connection members and said gas strut replaced by a new gas strut.

BRIEF DESCRIPTION OF THE DRAWINGS

Embodiments of the present invention will now be described by way of further example only and with reference to the accompanying drawings, in which.

DETAILED DESCRIPTION

Figure 1:
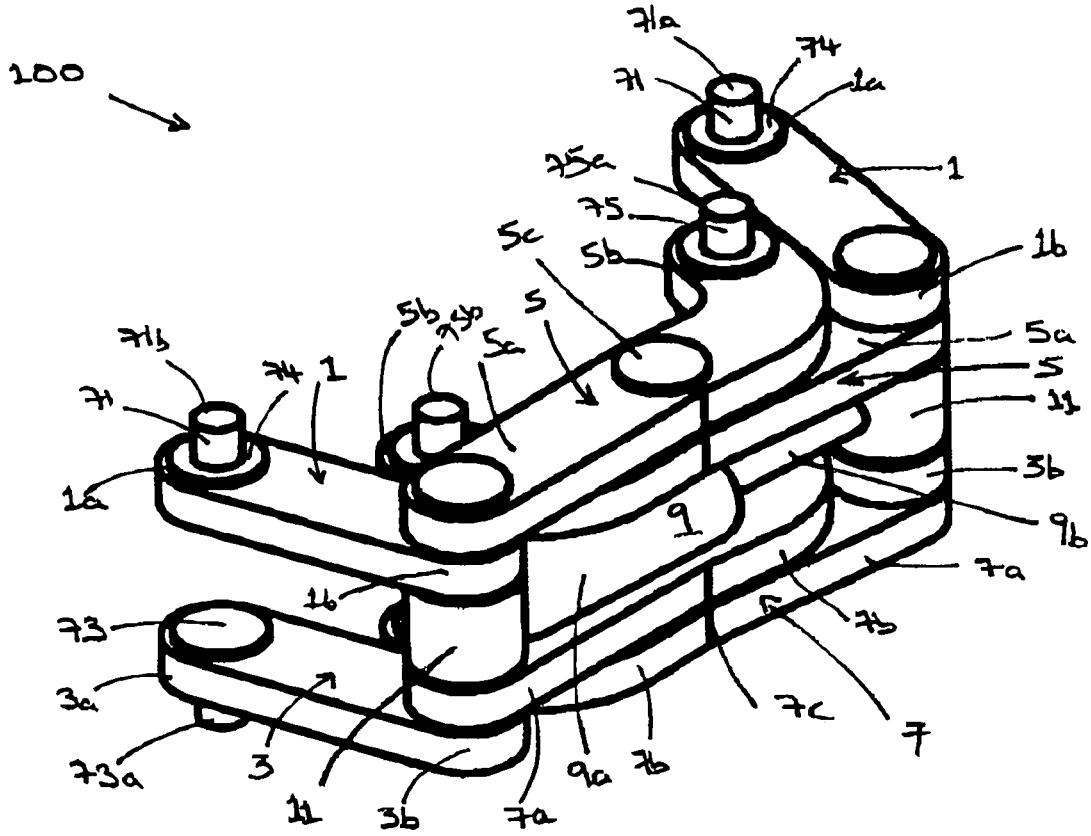
FIG. 1 illustrates a perspective view of a hinge of a first embodiment of the present invention in a fully open position.
Figure 2:
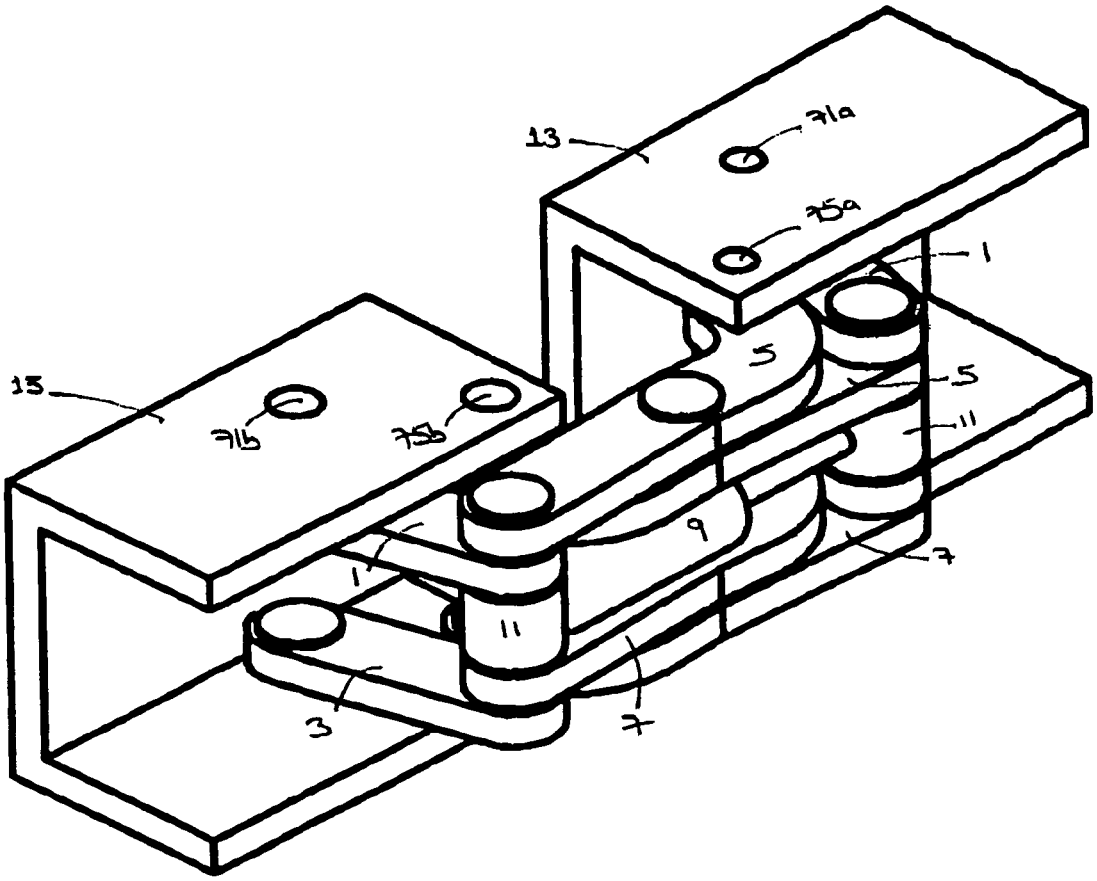
FIG. 2 illustrates a perspective view of a hinge of a first embodiment of the present invention in a fully open position connected to mounting blocks.
Figure 3:
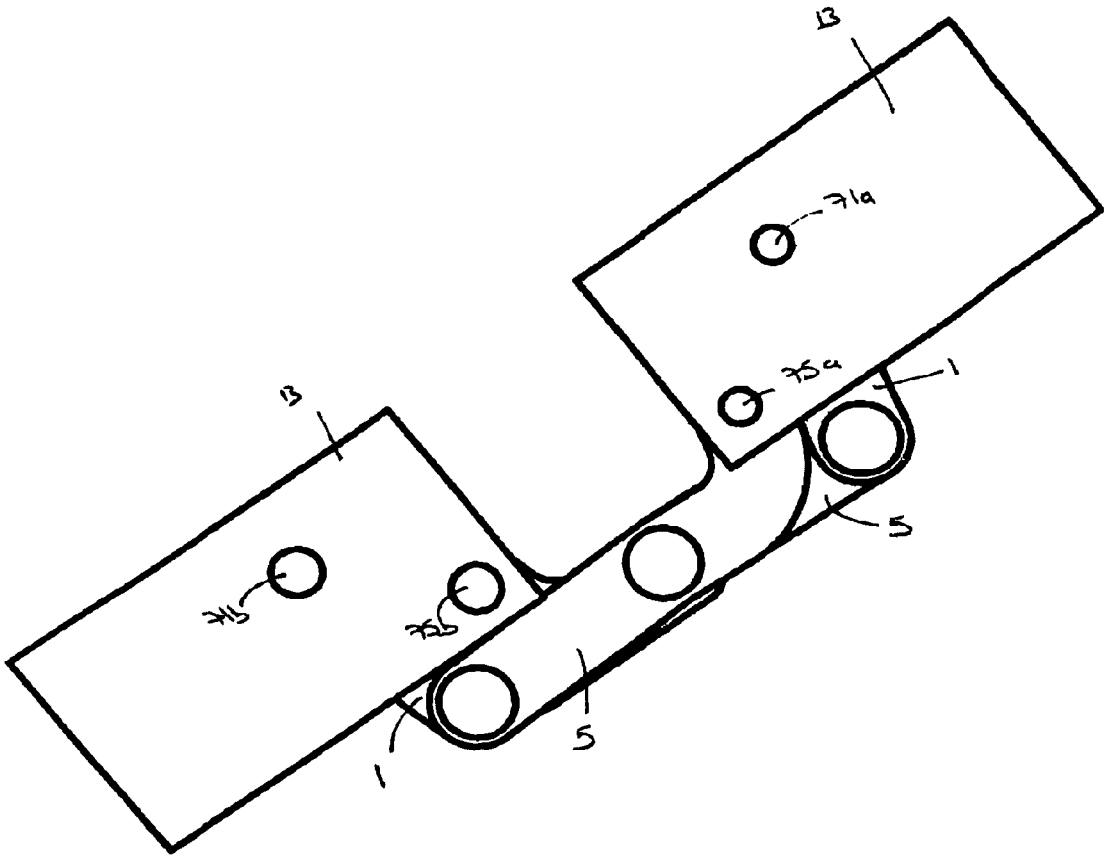
FIG. 3 illustrates a top view of a hinge of a first embodiment of the present invention in a fully open position connected to mounting blocks.

FIGS. 1 to 3 illustrate a hinge 100 of a first embodiment of the present invention in a fully open position. The hinge 100 comprises two upper support arms 1, two lower support arms 3, two upper control arms 5, two lower control arms 7 and a gas strut 9. One end 1*a*, 3*a* of each support arm 1, 3 is connected to a mounting block 13. The mounting blocks 13 are illustrated in FIGS. 2 and 3.

The other end 1*b*, 3*b* of each support arm 1, 3 is pivotally connected to a respective control arm 5, 7. As can be seen in FIGS. 1 to 9, each control arm 5, 7 has a straight end 5*a*, 7*a* and a curved end 5*b*, 7*b*. Each support arm 1, 3 is pivotally connected to the straight end 5*a*, 7*a* of each control arm 5, 7.

The two upper control arms 5 are pivotally connected to each other at a point 5*c* between the ends 5*a* and 5*b*, whilst the two lower control arms 7 are pivotally connected to each other at a point 7*c* between the ends 7*a* and 7*b*. The control arms 5, 7 may be connected at any point between the ends 5*a*, 7*a*, and the ends 5*b*, 7*b* respectively. However, the control arm 5, 7 may not be connected at the ends, such as end 5*a* being connected to end 5*a*, as this arrangement would prevent the hinge 100 from working correctly.

An upper layer comprising the two upper support arms 1 and the two upper control arms 5, and a lower layer comprising the two lower support arms 3 and the two lower control arms 7 are held apart by connectors 11, so that a space is maintained between the upper and lower layers. The space is such that a suitably sized gas strut 9 can be positioned between the upper and lower layers. The gas strut 9 is situated between the upper and lower layers and connected to the connectors 11. Preferably, the gas strut 9 does not extend outside the working envelope created by the upper and lower layers. The gas strut 9 may be connected to the connectors 11 by any suitable method such as using an adhesive, or welding. Alternatively, the gas strut 9 may have threaded ends and the connectors 11 have corresponding threaded recesses etc.

The gas strut 9 may have a shorter life than the hinge 100. Consequently, if the gas strut 9 is connected to the connectors 11 by a non-permanent means, such as by threaded ends, then it is possible to replace the gas strut 9 without having to replace the hinge 100.

In the embodiment illustrated in FIGS. 1 to 9, the gas strut 9 is attached to the control arms 5, 7 of the hinge 100 via the connectors 11. In an alternative embodiment, the gas strut 9 may be attached directly to the control arms 5, 7 of the hinge 100 without the connectors 11. However, the gas strut 9 is not attached to any surface to which the hinge 100 is attached. More specifically, the ends of the gas strut 9 pivot about the same pivot axes as the respective ends 1*b*, 5*a*, 3*b*, 7*a* of the support arms 1, 3 and the control arms 5, 7. Unlike the prior art, both these pivot axes are moveable relative to the bodies to which the hinge 100 is attached. Thus, the gas strut 9 is integrally formed with the hinge 100 and positioned within the working envelope of the hinge 100.

Figure 7:
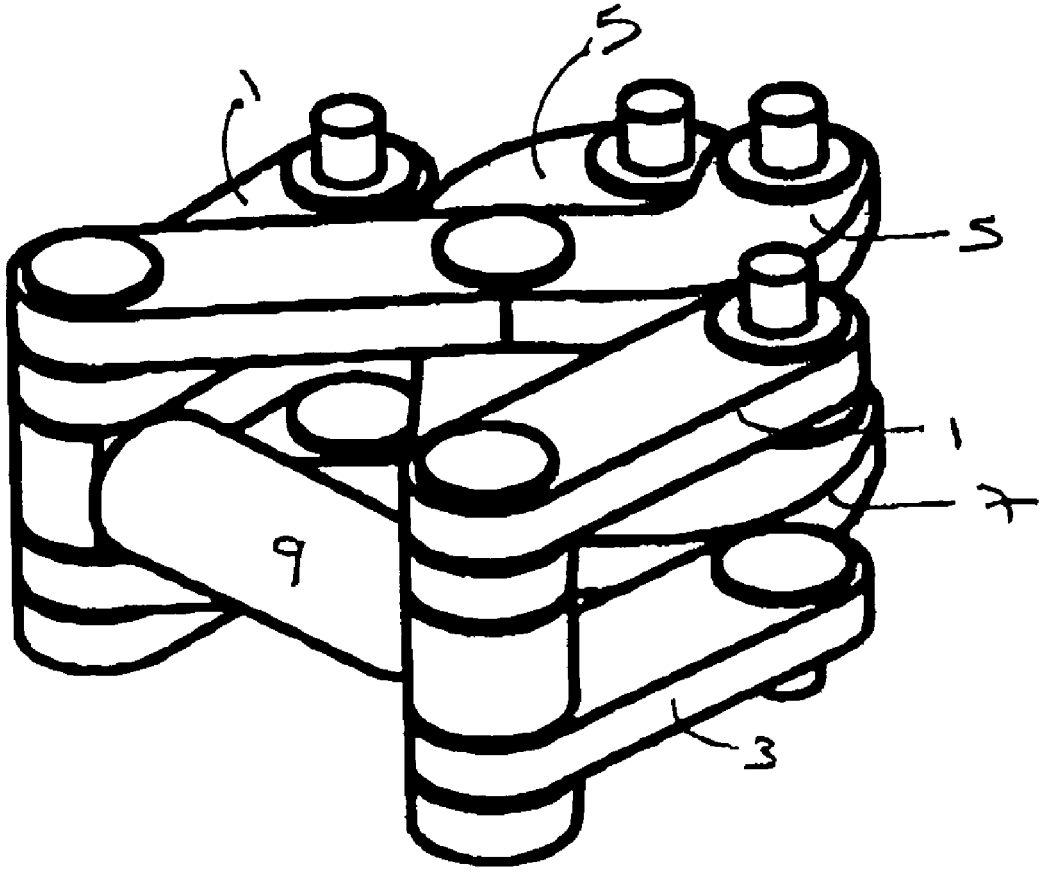
FIG. 7 illustrates a perspective view of a hinge of a first embodiment of the present invention in a closed position.

The gas strut 9 may be a push-type gas strut 9, which comprises a cylinder 9*a* and a piston 9*b*. The cylinder 9*a* may be filled with a gas such as air. When a substantial part of the piston 9*b* is pushed into the cylinder 9*a* by an applied force the volume within the cylinder 9*a* is reduced. Consequently, the pressure within the cylinder 9*a* is increased. FIG. 7 illustrates the hinge 100 to which a push-type gas strut 9 is connected as being closed. Thus, a substantial part of the piston 9*b* is forced into the cylinder 9*a*.

When the applied force which is holding a substantial part of the piston 9*b* within the cylinder 9*a* is removed, the increased pressure within the cylinder 9*a* forces a substantial part of the piston 9*b* out of the cylinder 9*a*. FIG. 1 illustrates the hinge 100 to which a push-type gas strut 9 is connected as being open when a substantial part of the piston 9*b* is forced out of the cylinder 9*a*.

Consequently, the push-type gas strut 9 is configured such that a substantial part of the piston 9*b* must be pushed into the cylinder 9*a* of the gas strut 9 by an applied force, and a substantial part of the piston 9*b* is pushed out of the cylinder 9*a* by the increased pressure within the cylinder 9*a*. Thus, a door to which a hinge 100 comprising a push-type gas strut 9, is attached must be held closed by a latch mechanism. However, a door to which a hinge 100 comprising a push-type gas strut 9, is attached will open by itself when the latch mechanism is released.

Alternatively, the gas strut 9 may be a pull-type gas strut 9, which comprises a cylinder 9*a* and a piston 9*b*. The cylinder 9*a* may be filled with a gas such as air. When a substantial part of the piston 9*b* is pulled out of the cylinder 9*a* by an applied force the volume within the cylinder 9*a* is increased. Consequently, the pressure within the cylinder 9*a* is decreased. FIG. 1 illustrates the hinge 100 to which a pull-type gas strut 9 is connected as being open when a substantial part of the piston 9*b* is pulled out of the cylinder 9*a* by an applied force.

When the applied force which is holding a substantial part of the piston 9*b* out of the cylinder 9*a* is removed, the decreased pressure within the cylinder 9*a* pulls a substantial part of the piston 9*b* within the cylinder 9*a*. FIG. 7 illustrates the hinge 100 to which a pull-type gas strut 9 is connected as being closed. Thus, a substantial part of the piston 9*b* is pulled into the cylinder 9*a*.

Consequently, the pull-type gas strut 9 is configured such that a substantial part of the piston 9*b* must be pulled out of the cylinder 9*a* of the gas strut 9 by an applied force, and a substantial part of the piston 9*b* is pulled into of the cylinder 9*a* by the decreased pressure within the cylinder 9*a*. Thus, a door to which a hinge 100 comprising a pull-type gas strut 9, is attached must be held open by a latch mechanism.

However, a door to which a hinge 100 comprising a pull-type gas strut 9, is attached will close by itself when the latch mechanism is released.

The gas strut 9 is sized so that the piston 9*b* is half the length of the cylinder 9*a*. However, the present invention is not limited to this arrangement and different sized gas struts 9 may be used depending on the specific requirements of the hinge 100. For example, the hinge 100 may comprise a 5 kg gas strut 9, which can easily open a 200 kg door.

A description of how a hinge 100 comprising a push-type gas strut 9 of the present invention operates will now be given with reference to FIGS. 1, 2, 4, 5, 7 and 8. FIGS. 1 and 2 illustrate the hinge 100 in its fully open position. To close the hinge 100, a force is applied to one of the mounting blocks 13. This causes the control arms 5, 7 to pivot about points 5*c*, 7*c* as the curved ends 5*b*, 7*b* move closer to each other. Thus, the straight ends 5*a*, 7*a* move closer to each other. The support arms 1, 3 therefore also begin to pivot about the ends 1*b*, 3*b* where they are attached to the control arms 5, 7. As the control arms 5, 7 pivot, and their straight ends 5*a*, 7*a* move closer together, the piston 9*b* of the gas strut 9 is forced into the cylinder 9*a*, increasing the pressure inside the cylinder 9*a*.

Figure 4:
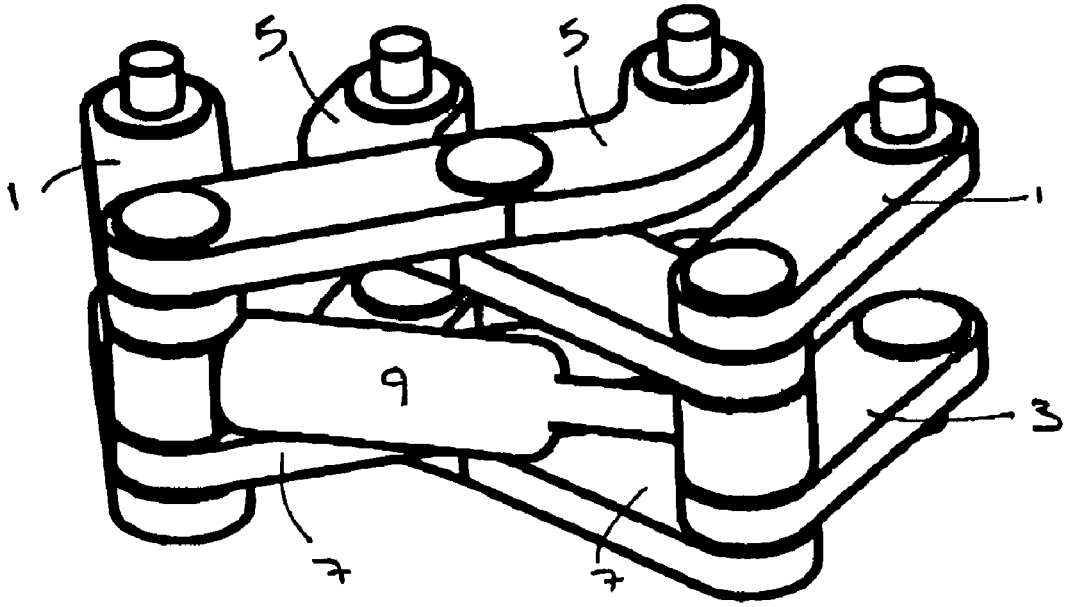
FIG. 4 illustrates a perspective view of a hinge of a first embodiment of the present invention in a partially open position.
Figure 5:
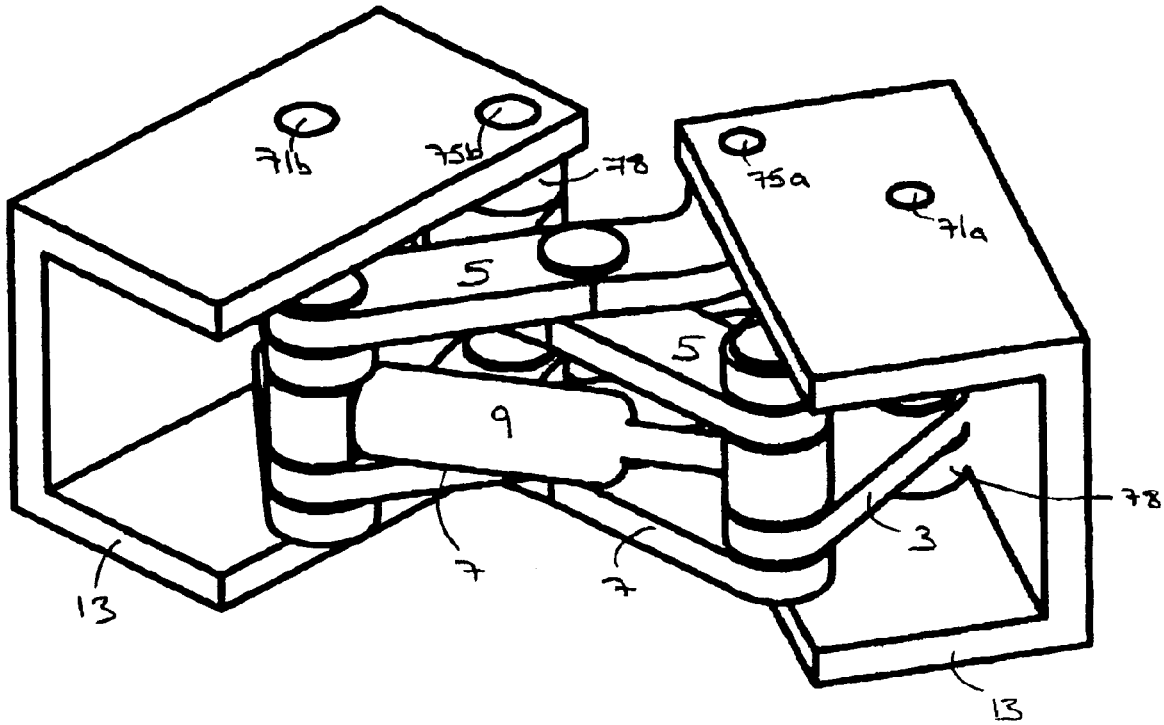
FIG. 5 illustrates a perspective view of a hinge of a first embodiment of the present invention in a partially open position connected to mounting blocks.
Figure 6:
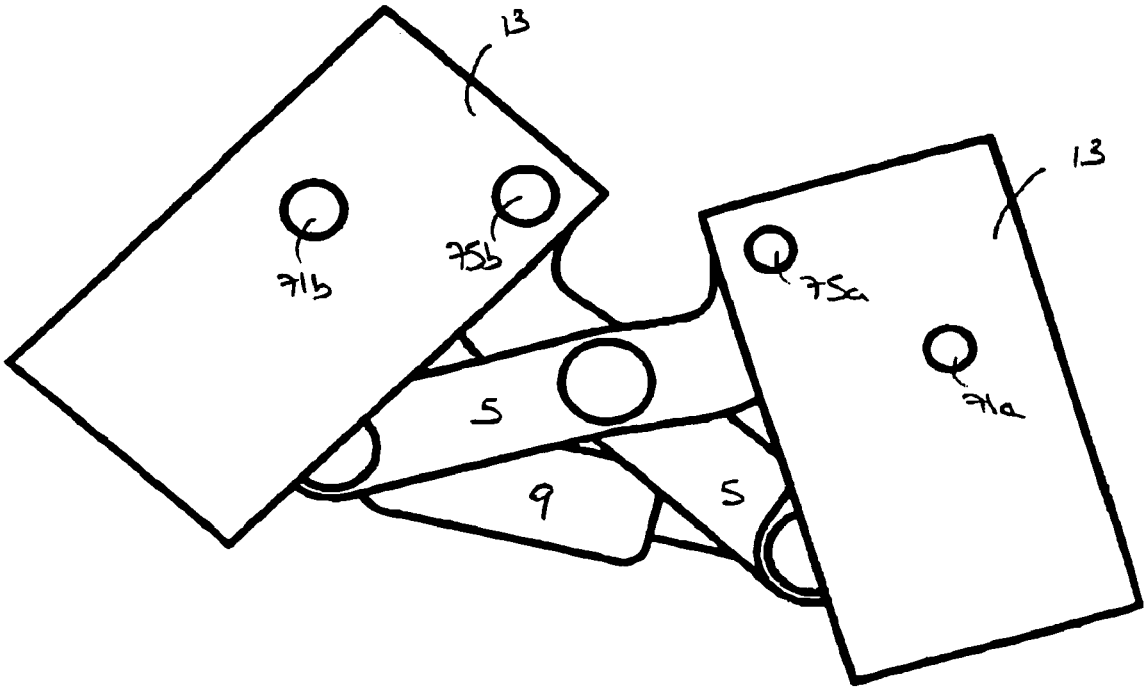
FIG. 6 illustrates a top view of a hinge of a first embodiment of the present invention in a partially open position connected to mounting blocks.

FIGS. 4 and 5 illustrate the hinge 100 in a partially closed position. From FIG. 4, it can be seen that the ends 1*a*, 3*a* of the support arms 1, 3 and the curved ends 5*b*, 7*b* of the control arms 5, 7 have pivoted about the point at which they are connected to the mounting blocks 13. As the force is continued to be applied to the mounting block 13, the straight ends 5*a*, 7*a* of the control arms 5, 7 move closer together and the pressure in the gas strut 9 is increased as the piston 9*b* is forced further into the cylinder 9*a*.

Figure 8:
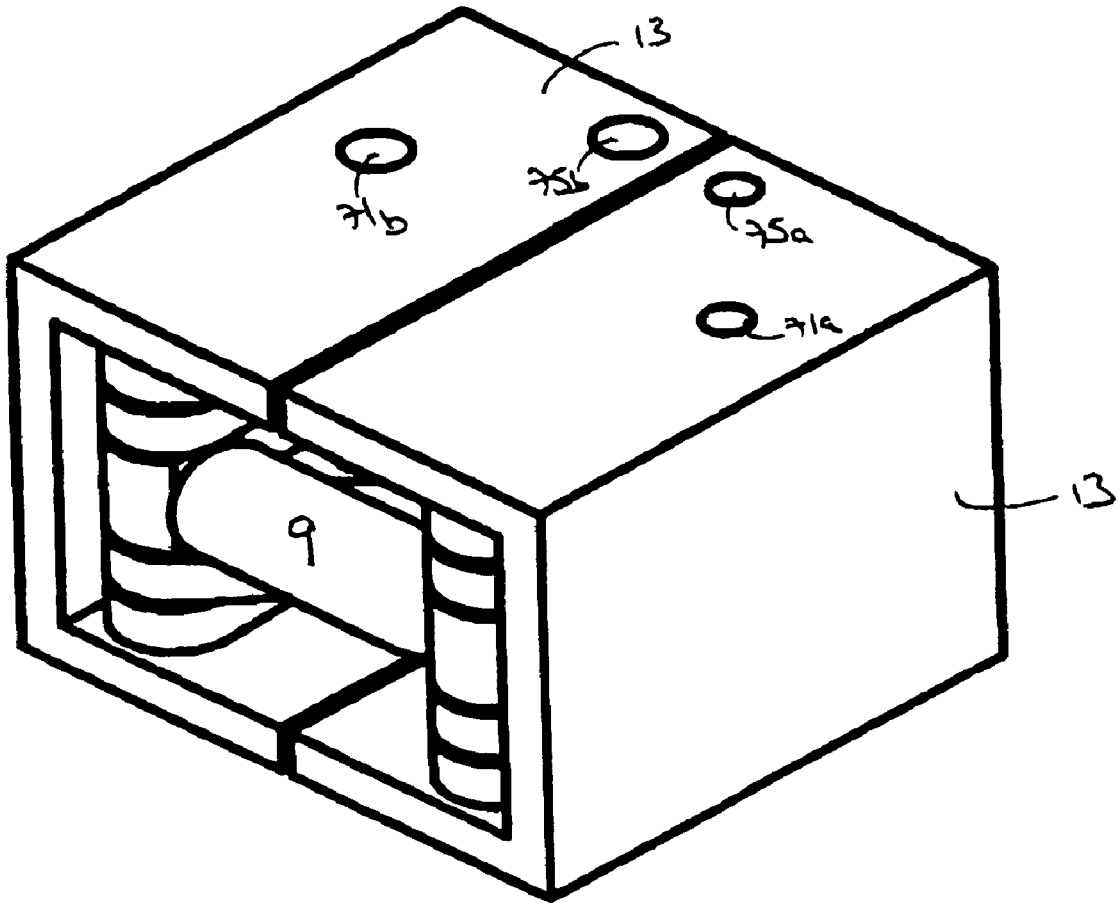
FIG. 8 illustrates a perspective view of a hinge of a first embodiment of the present invention in a closed position connected to mounting blocks.
Figure 9:
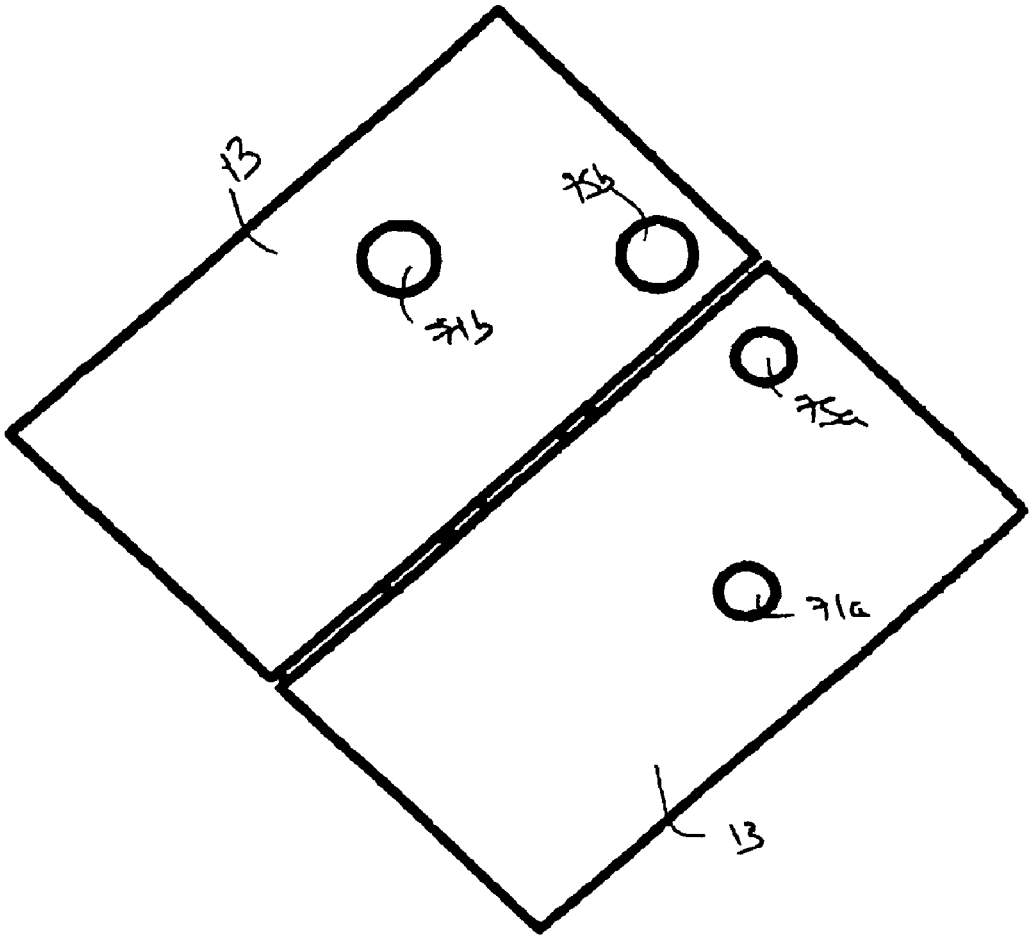
FIG. 9 illustrates a top view of a hinge of a first embodiment of the present invention in a closed position connected to mounting blocks.

Eventually, as illustrated in FIGS. 7 and 8, the control arms 5, 7 will have pivoted such that the outer surfaces of the curved ends 5*b*, 7*b* abut the inner surfaces of the ends 1*a*, 3*a* of the support arms 1, 3 and the piston 9*b* has been forced completely into the cylinder 9*a*. The hinge 100 is now completely closed.

In an alternative embodiment, the hinge 100 of the present invention may be completely closed when the outer surfaces of the curved ends 5*b*, 7*b* of the control arms 5, 7 abut against a stop member. The hinge 100 of the present invention also may be completely closed when the two mounting blocks 13, or the relevant bodies to which the hinge 100 is directly or indirectly attached, come into contact with each other, which may be set to happen before the outer surfaces of the curved ends 5*b*, 7*b* of the control arms 5, 7 abut the inner surfaces of the ends 1*a*, 3*a* of the support arms 1, 3. Similarly, maximum closure of the hinge 100 may be determined by the size of the gas strut 9. In all of the embodiments, the piston 9*b* does not have to be forced completely into the cylinder 9*a* when the hinge 100 is closed. However, the pressure inside the cylinder 9*a*, must have increased enough so that gas strut 9 aids with the opening of the hinge 100.

When the applied force is removed from the mounting block 13, the pressure inside the cylinder 9*a*, forces the piston 9*b* out of the cylinder 9*a*. This results in the control arms 5, 7 pivoting about point 5*c*, 7*c*, moving the curved ends 5*b*, 7*b* away from each other and the support arms 1, 3. This movement causes the hinge 100 to slightly open, as illustrated in FIGS. 4 and 5. At the same time, the support arms 1, 3, pivot about the ends 1*b*, 3*b* at which they are connected to the control arms 5, 7.

The pressurised cylinder 9*a* continues to force the piston 9*b* out of the cylinder 9*a* until the hinge 100 is fully open, as illustrated in FIGS. 1 and 2.

The hinge 100 may be attached to a fixed body, such as a wall, and a moveable body, such as a door, via the mounting blocks 13. When the hinge 100 of the present invention opens, the action of the hinge 100 results in the moveable body moving out and away from the fixed body.

As illustrated in FIGS. 1 to 9 and 12*a* to 12*c*, the mounting blocks 13 to which the hinge 100 is attached moves 180° from the fully closed position, illustrated in FIGS. 7 to 9 and 12*c*, to the fully open position, illustrated in FIGS. 1 to 3, 12*a* and 12*b*.

Although the above description and figures described the hinge 100 as opening 180°, the hinge 100 of the present invention may be constructed such that it can only be opened to any arbitrarily selected angle such as 70°, 120° or 230° etc.

Preferably, the curved ends 5*b*, 7*b* of the control arms 5, 7 are shaped such that the flat outer surfaces of the curved ends 5*b*, 7*b* abut the flat inner surfaces of the ends 1*a*, 3*a*, of the support arms 1, 3 when the hinge has reached its fully open position. In this way, a highly accurate positive lockout is achieved. Consequently, the curve of the curved ends 5*b*, 7*b* of the control arms 5, 7 is determined based on the predetermined maximum angle to which the hinge 100 is to open. Therefore, the curved ends 5*b*, 7*b* of the control arms 5, 7 may have any shaped curve that results in the hinge 100 opening to a predetermined maximum angle such as 70°, 120° or 230° etc.

Alternatively, the hinge 100 may be prevented from opening past a predetermined maximum angle by the use of separate stop members rather than by altering the curve of the curved ends 5*b*, 7*b* of the control arms 5, 7.

Although the control arms 5, 7 are illustrated as having a curved end 5*b*, 7*b*, the present invention is not limited to this configuration. The hinge 100 of the present invention may in an alternative embodiment comprise straight control arms 5, 7, which do not comprise a curved end 5*b*, 7*b*. However, if the control arms 5, 7 are straight, then the straight end 5*a*, 7*a* of the control arms 5, 7 would not be parallel with each other when the hinge 100 is in the fully open position, as illustrated in FIGS. 1 to 3. The straight control arms 5, 7 would project beyond the working envelope of a hinge 100 comprising curved control arms 5, 7, and thus utilise more space than the curved control arms 5, 7. Consequently, it is preferable for the control arms 5, 7 to have a curved end 5*b*, 7*b*.

If the control arms 5, 7 are straight, then the use of separate stop members is preferred in order to prevent the hinge 100 from opening past a predetermined maximum angle.

In a preferred embodiment, in use, a hinge 100 of the present invention may be attached to a door. Due to the increased pressure in the push-type gas strut 9 when the hinge 100 is closed, the door to which the hinge 100 is attached is required to be held shut by a catch, or latching mechanism etc. When the latching mechanism is released, the gas strut 9 causes the door to open, and the hinge 100 then holds the door in the open position. No latching mechanism is required in order to hold the door (hinge 100) in the open position.

In order to close the door (hinge 100), a force must be applied in order to overcome the held open position, and must continue to be applied until the door (hinge 100) is closed and the latching mechanism reapplied.

The use of either a push-type or pull-type gas strut 9 in the hinge 100 means that a door, to which the hinge 100 may be attached, cannot be slammed shut and cannot be opened violently. The door swings smoothly open at a controlled speed and can only be pushed shut at a controlled speed.

In an alternative embodiment, the push-type gas strut 9 may be sized such that it does not cause the door to open, but merely aids with the opening of the door. For example, a hinge 100 of the present invention may be applied to a very heavy door, and the gas strut 9 may be of a calibre such that it makes it easier for a user to push the door open, but is not capable of causing the door to open on its own. Additionally, if the gas strut 9 is such that it cannot hold a door in an open position, then a locking mechanism may be required in order to hold the door open.

In the embodiment illustrated in FIG. 12, the mechanical design of the arms 1, 3, 5, 7 holds the weight of the door to which the hinge 100 is attached. Thus, the gas strut 9 only needs to overcome the coefficient of friction in the hinge 100 in order to open the door, which is very low compared to the weight of the door. Additionally, the dimensions of the hinge 100 and the pressure in the cylinder 9*a* of the gas strut 9 are calculated based on the weight of the door to which it will be applied. Even where a factor of safety of five is introduced in order to increase the reliability and safety of the hinge 100, a comparatively small hinge 100 can still be used.

The hinge 100 of the present invention may be positioned with its pivot axes vertical, horizontal or any orientation therebetween when attached to a door. Consequently, the hinge 100 of the present invention may be used to open a wide range of doors. For example, the hinge 100 of the present invention may be attached to a door of a kitchen cabinet, a door on a truck cabin, doors used on boats or yachts, the bonnet of a car, a door of an overhead compartment used on aeroplanes, or an aircraft fuselage door. However, a more powerful gas strut 9 may be required when the hinge 100 is positioned with its pivot axes horizontal.

The hinge 100 of the present invention is particularly beneficial when it is used on doors on boats or yachts which may be subject to rough water, which results in the hinges of the prior art causing doors to slam open and shut. As stated above, the gas strut 9 of the hinge 100 of the present invention prevents doors from slamming open or shut.

Additionally, the hinge 100 of the present invention is particularly beneficial when it is used on doors and fixed bodies which have a curvature, as the hinge 100 enables the door to move out and away from the fixed body, when the door is being opened. This is also beneficial when the hinge 100 is used on doors which have a sealing material positioned around an outer edge of the door and/or fixed body. The out and away/in and towards action means that the door closes square onto the face of the sealing material so that the sealing material is not damaged.

It is common in the art to mount a door to a fixed body using two hinges, the upper hinge preventing the door from any vertical movement in relation to the fixed body, and the lower hinge preventing the door from any horizontal movement in relation to the fixed body. Thus, the door is only capable of rotational movement about the axis where the door is connected to the fixed body by the hinges.

However, the hinge 100 of the present invention is not limited to the use of two hinges when mounting a door to a fixed body, and any number of hinges 100 may be used depending on the specific requirements of the situation.

Although the above description describes the hinge 100 in relation to doors, the present application is not limited to this arrangement. Specifically, the hinge 100 may be attached between a fixed body (such as a wall) and a moveable body (such as a door). Alternatively, the hinge 100 may be attached to two moveable bodies that move relative to one another.

In a preferred embodiment, the support arms 1, 3 and the control arms 5, 7 have radiused corners and edges so that there are no snag points.

The hinge 100 is completely self contained and thus can not be pulled apart. Additionally, due to the smooth action of the hinge and the configuration of the arms, the hinge 100 is child friendly as fingers cannot be caught in the hinge 100 as the door cannot be shut quickly.

Figure 12A:
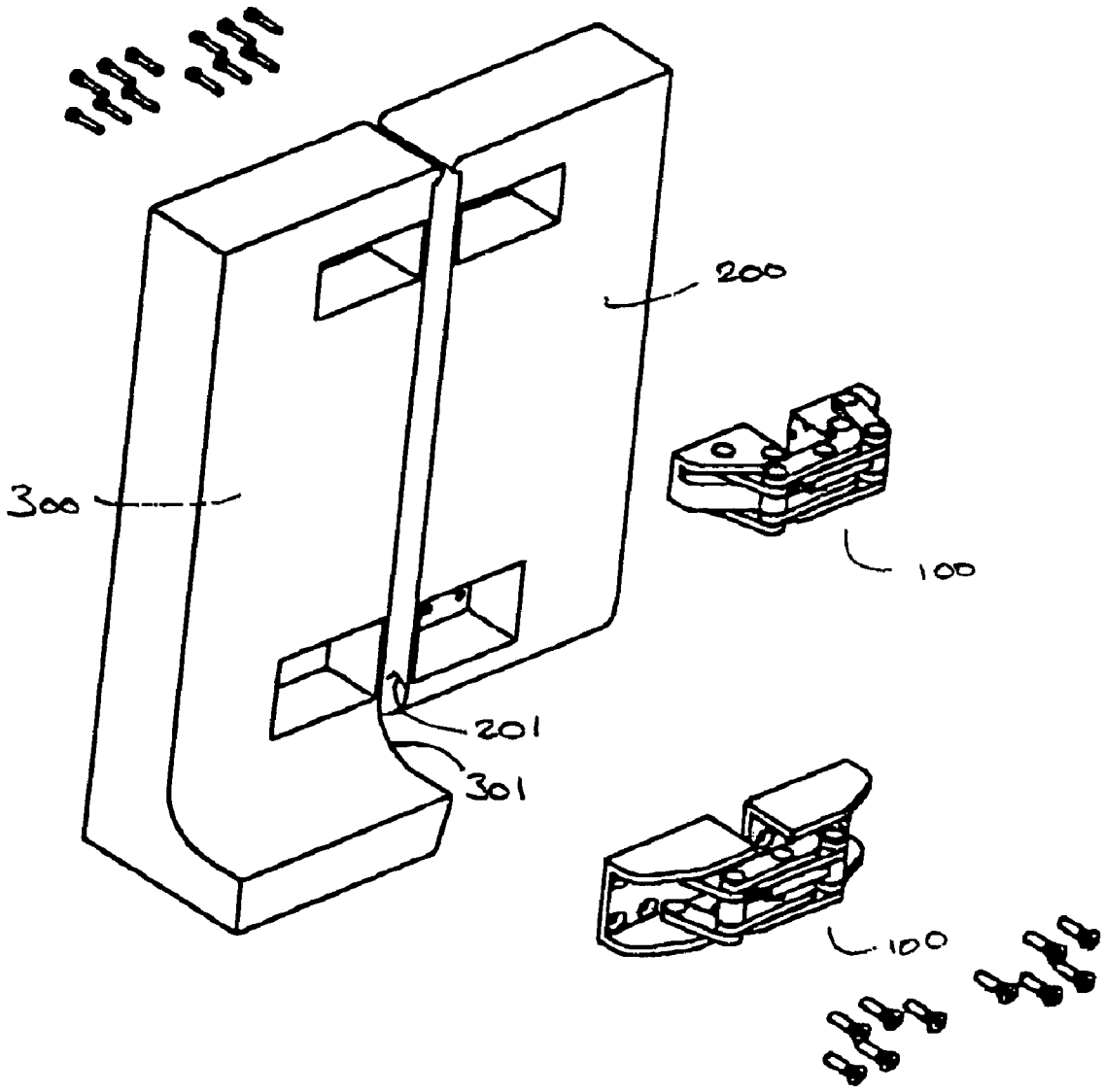
FIGS. 12*a*, 12*b* and 12*c* illustrate the attachment of a hinge of the present invention to a body, such as a door or a wall.
Figure 12B:
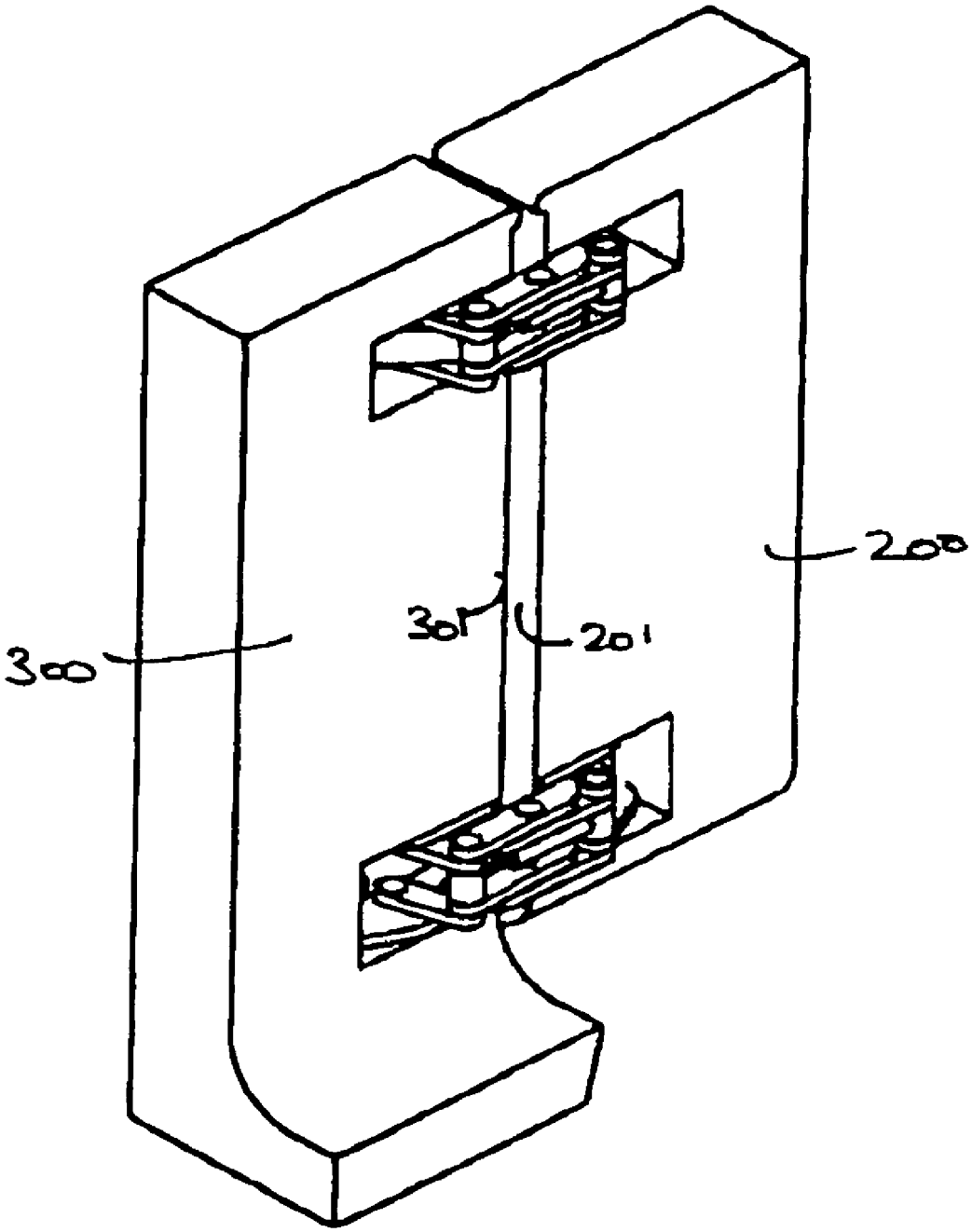
Figure 12C:
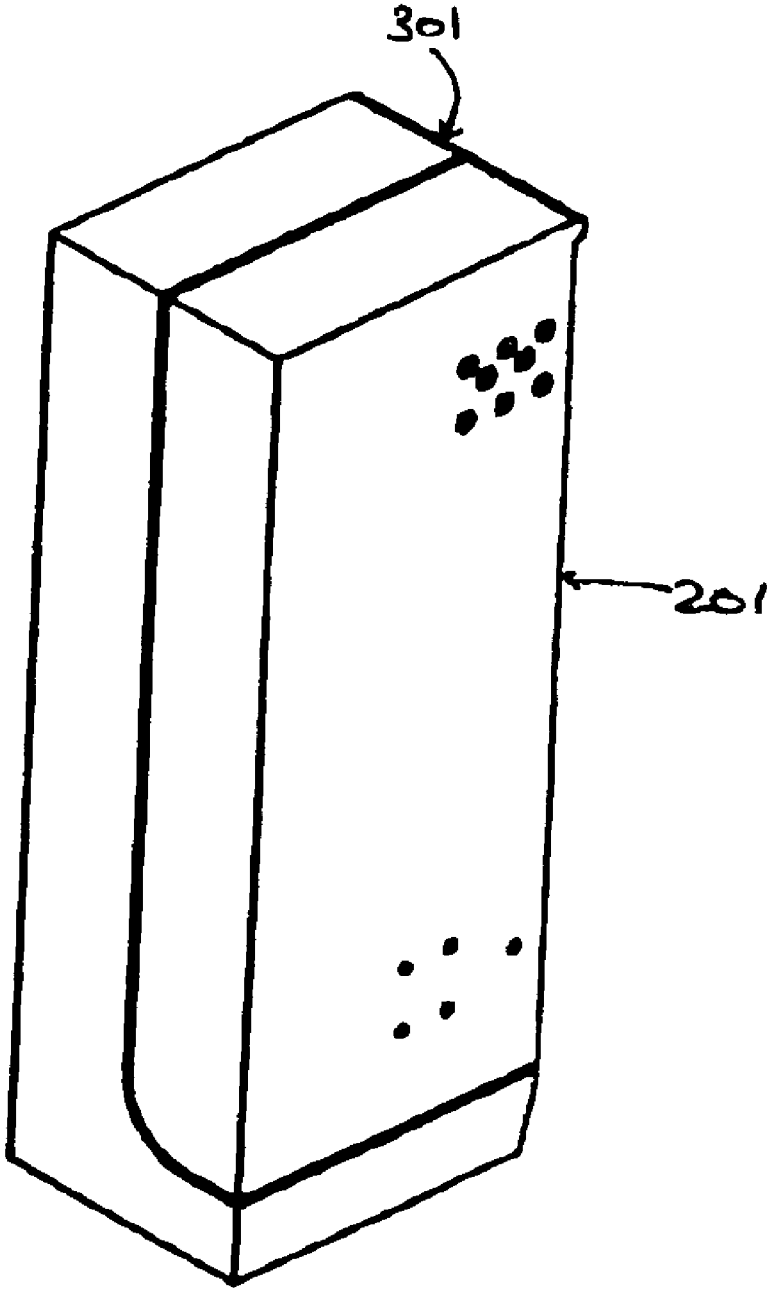
Figure 13:
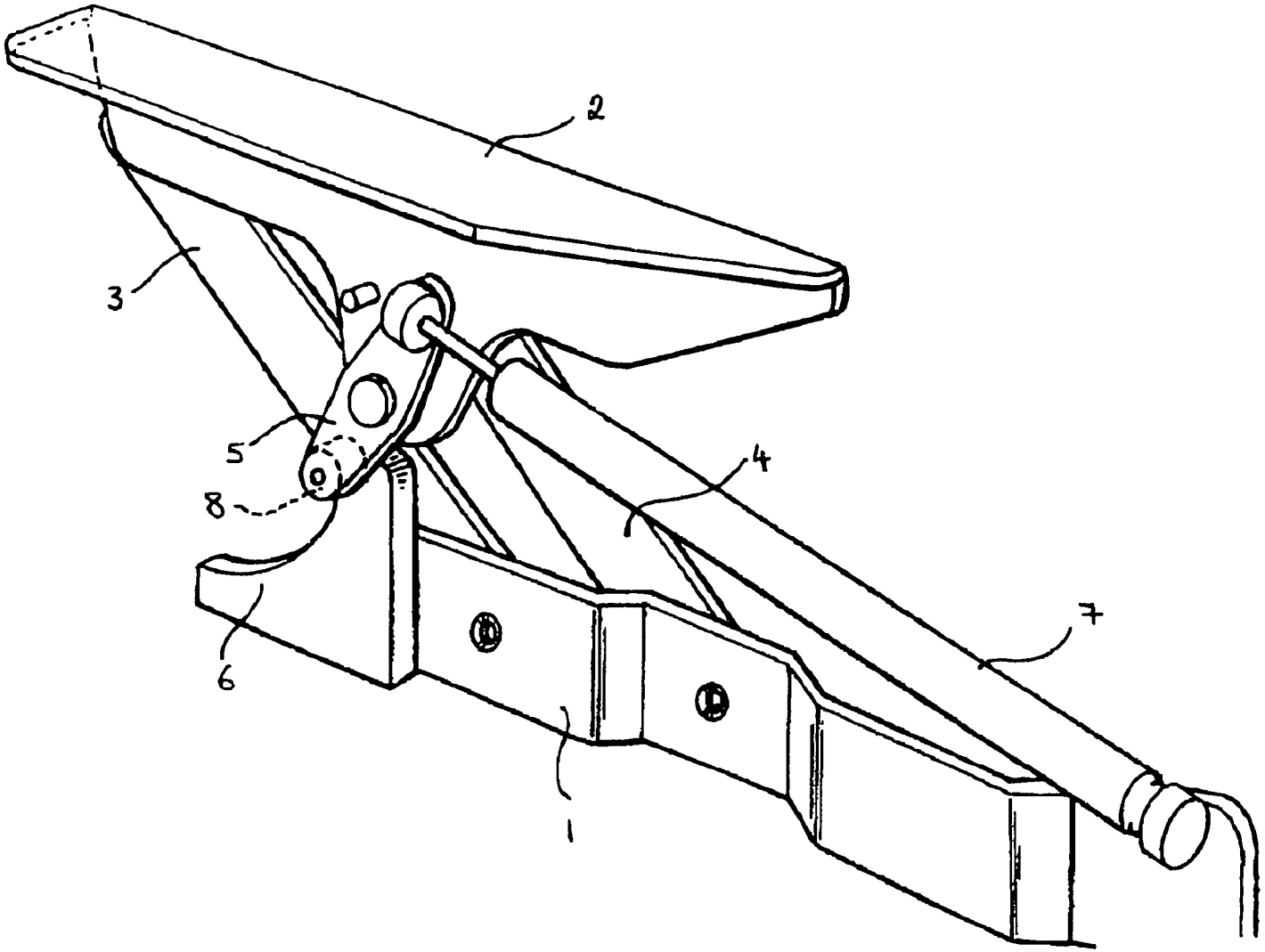
FIG. 13 illustrates a perspective view of a hinge of the prior art.

Additionally, the hinge 100 of the present invention has a small mounting envelope in relation to the strength of the hinge 100 and the loading it can take, when compared with hinges of the prior art. Accordingly, a relatively small hinge 100 can be used on big/heavy doors which would normally require a bigger hinge which utilises more space. Furthermore, the hinge 100 is recessed within the door/wall to which it is affixed, as illustrated in FIGS. 12*a* to 12*c*. Consequently, when a door to which the hinge 100 of the present invention is attached is closed the hinge 100 is hidden from view. Even when the door is open the hinge 100 of the present invention barely extends from the door/wall to which it is attached, and the gas strut 9 does not extend further than the hinge 100. This results in a hinge 100 which is very aesthetically pleasing, and which does not snag clothing when a user walks close to the hinge 100.

Moreover, if the hinge is rotated 180° more or less about a longitudinal axis of one of the support arms 1, 3, so that the lower layer becomes the upper layer and vice versa, then the hinge 100 appears the same. Consequently, the hinge 100 can not be inserted "upside down" by mistake.

The hinge 100 of the present invention is relatively cheap to produce as it comprises several like components, i.e. all four support arms 1, 3 are exactly the same and all four control arms 5, 7 are exactly the same, thus reducing the cost of production.

However, the hinge 100 of the present invention may be produced having different sized/shaped support arms 1, 3, control arms 5, 7 and mounting blocks 13 than those illustrated in the figures. Additionally, the hinge 100 of the present invention may be produced having different sized/shaped support arms 1, 3 to each other and/or different sized/shaped control arms 5, 7 to each other and/or different sized/shaped mounting blocks 13 to each other depending on the requirements of the hinge 100.

Although the hinge 100 is illustrated in FIGS. 1 to 9 as comprising an upper layer and a lower layer, the hinge 100 may be provided with only an upper layer and a gas strut 9 or only a lower layer and a gas strut 9, the gas strut 9 being connected to the control arms 5 or 7 of that layer.

The hinge 100 of the present invention may also be provided without support arms 1, 3. This is because it is the control arms 5, 7 which predominantly assist in opening and closing of the hinge 100, whilst the support arms 1, 3 dictate the route of travel of the hinge 100 and provide increased strength and stability. Consequently, the hinge 100 may comprise only two control arms 5, 7 and a gas strut 9. It is the inner most three pivot points do most of the load bearing.

Alternatively, the hinge 100 may comprises more or less arms 1, 3, if required, and consequently a different number of pivot points.

In FIGS. 1 to 9, the gas strut 9 is illustrated as being attached to the ends 5*a*, 7*a* of the control arms 5, 7. However, this is a preferable arrangement. The gas strut 9 may be attached to the control arms 5, 7 at any position between the ends 5*a*, 7*a* and the pivot point 5*c*, 7*c*.

The left support arm 1 and left control arm 5 of the upper layer, and right support arm 3 and right control arm 7 of the lower layer, in FIGS. 1 and 2, are positioned away from the horizontal surfaces of the mounting blocks 13, when compared to the right support arm 1 and right control arm 5 of the upper layer, and left support arm 3 and left control arm 7 of the lower layer respectively.

Figure 10A:
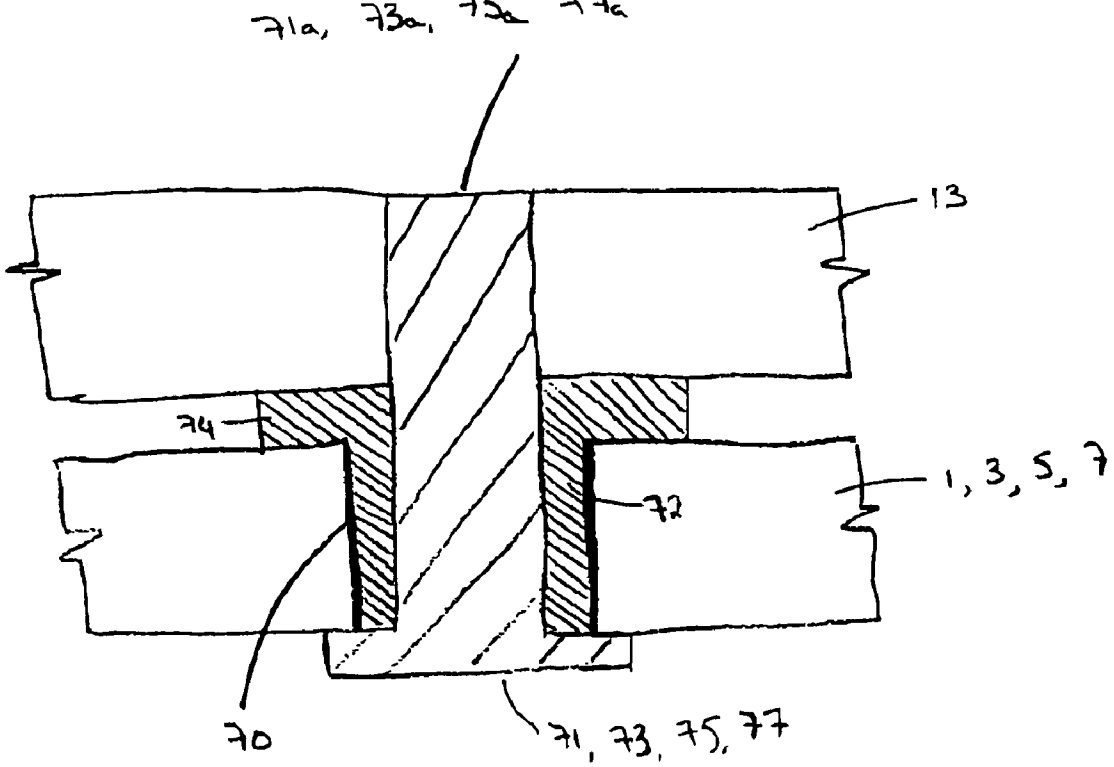
FIGS. 10*a*, 10*b* and 10*c* illustrate a pin assembly used to attach a hinge of a first embodiment of the present invention to mounting blocks.

The right support arm 1 and right control arm 5 of the upper layer, and left support arm 3 and left control arm 7 of the lower layer can be connected to the mounting blocks 13 by way of the pin assembly illustrated in FIG. 10*a*. FIG. 10*a* illustrates a pin 71, 73, 75, 77 used to connect the ends 1*a*, 3*a* of the support arms 1, 3 and the curved ends 5*b*, 7*b* of the control arms 5, 7 to the mounting blocks 13.

One through hole 70 is formed in each of the ends 1*a*, 3*a* of the support arms 1, 3 and the curved ends 5*b*, 7*b* of the control arms 5, 7. A moulded bearing 72 is then press fit into each hole 70, and a pin 71, 73, 75, 77 positioned within each bearing 72, such that an end 71*a*, 73*a*, 75*a*, 77*a* of the pin 71, 73, 75, 77 projects from the hole 70. The bearing 72 can be rotated around the pin 71, 73, 75, 77. The moulded bearing 72 comprises a flange portion 74 which sits on a surface of the ends 1*a*, 3*a* of the support arms 1, 3 and the curved ends 5*b*, 7*b* of the control arms 5, 7. The projecting end 71*a*, 73*a*, 75*a*, 77*a* of the pin 71, 73, 75, 77 is connected via interference fit to a mounting block 13, such that the flange portion 74 of the pin 70 separates the ends 1*a*, 3*a* of the support arms 1, 3 and the curved ends 5*b*, 7*b* of the control arms 5, 7 from the mounting block 13.

Although the present invention is described as having interference fit pins 71, 73, 75, 77, any method of connection may used as long as the ends 1*a*, 3*a* of the support arms 1, 3 and the curved ends 5*b*, 7*b* of the control arms 5, 7 are free to pivotally rotate in relation to the mounting blocks 13.

Figure 10B:
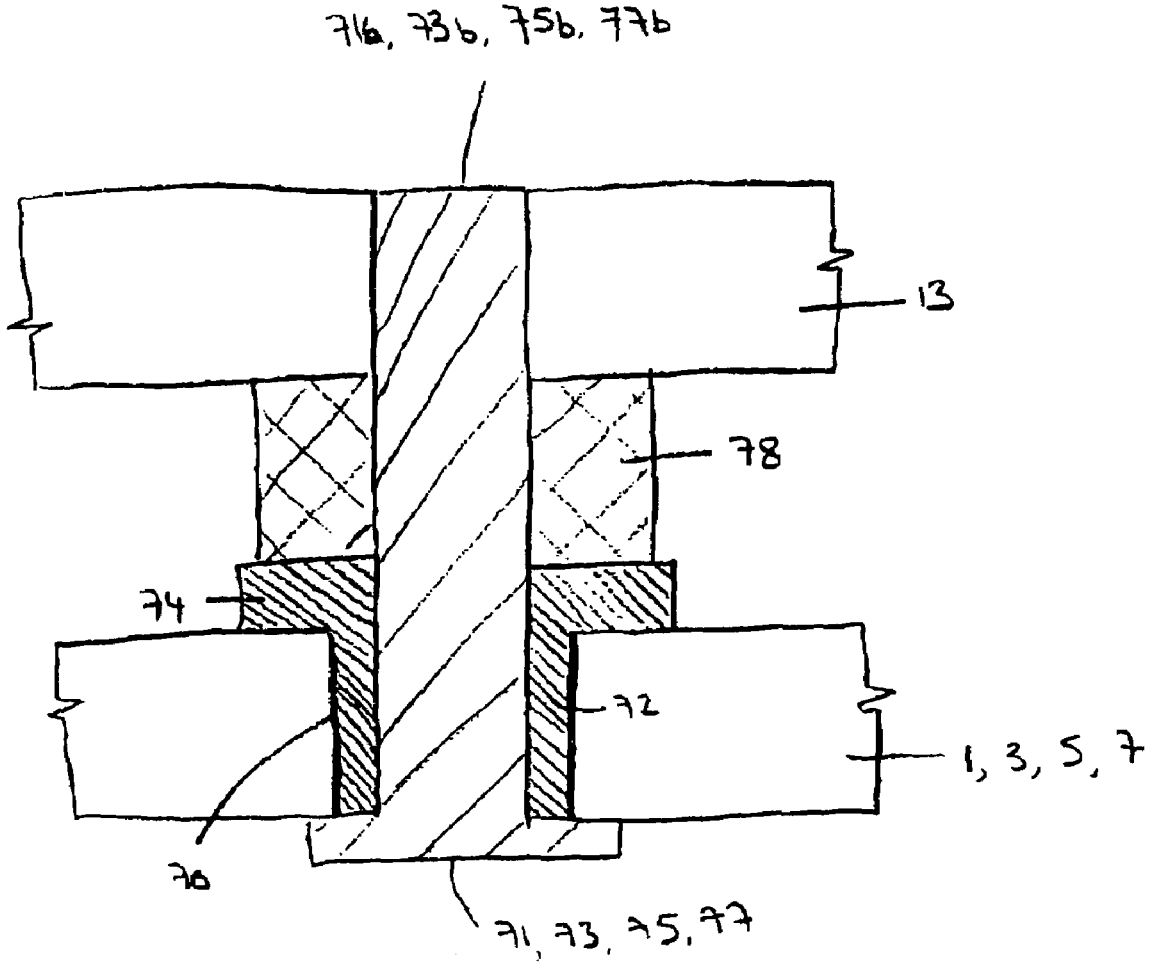

The left support arm 1 and left control arm 5 of the upper layer, and the right support arm 3 and the right control arm 7 of the lower layer, in FIGS. 1 and 2, can be connected to the mounting blocks 13 by way of the pin assembly illustrated in FIG. 10*b*. FIG. 10*b* illustrates a pin 71, 73, 75, 77 used to connect the ends 1*a*, 3*a* of the support arms 1, 3 and the curved ends 5*b*, 7*b* of the control arms 5, 7 to the mounting blocks 13. A spacer 78 is positioned between the ends 1*a*, 3*a* of the support arms 1, 3 and the curved ends 5*b*, 7*b* of the control arms 5, 7 and the mounting block 13 so that the axis of rotation of each pivot point is parallel to the effective axis of rotation of a door to which the hinge 100 may be attached.

The spacer 78 may be a cylindrical spacer which fits over the end of the pin 71*b*, 75*b*, 73*b*, 77*b*, the pin 71*b*, 75*b*, 73*b*, 77*b* being longer than the pin 71*a*, 75*a*, 73*a*, 77*a* such that the top of pin 71*b*, 75*b*, 73*b*, 77*b* is level with the top of pin 71*a*, 75*a*, 73*a*, 77*a*.

Figure 10C:
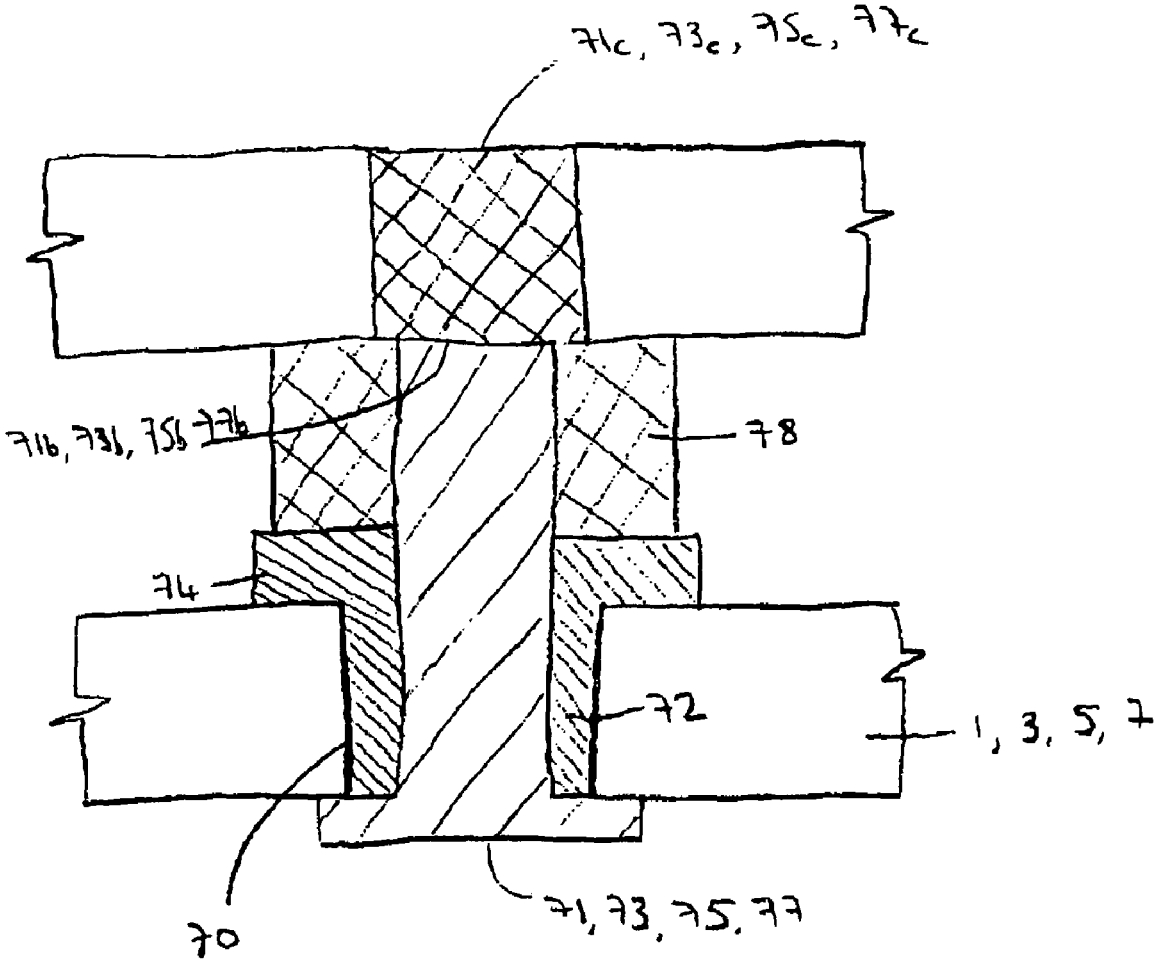

Alternatively, if the pins 71*a*, 71*b*, 75*a*, 75*b*, 73*a*, 73*b*, 77*a* and 77*b* are equal in height, then the spacer 78 may be a cylindrical spacer which fits over the end of the pin 71*b*, 75*b*, 73*b*, 77*b*, and has a pin 71*c*, 73*c*, 75*c*, 77*c* extending from its top, as illustrated in FIG. 10*c*. In this case, the pin 71*c*, 73*c*, 75*c*, 77*c* is in contact with the mounting block 13 and the top of pin 71*c*, 73*c*, 75*c*, 77*c* is level with the top of pin 71*a*, 73*a*, 75*a*, 77*a*. However, the present invention is not limited to these arrangements and any form of spacer may be used.

Additionally, the pins 71*a*, 71*b*, 73*a*, 73*b* of the support arms 1, 3 preferably have a larger diameter than the pins 75*a*, 75*b*, 77*a*, 77*b* of the control arms 5, 7.

Figure 14A:
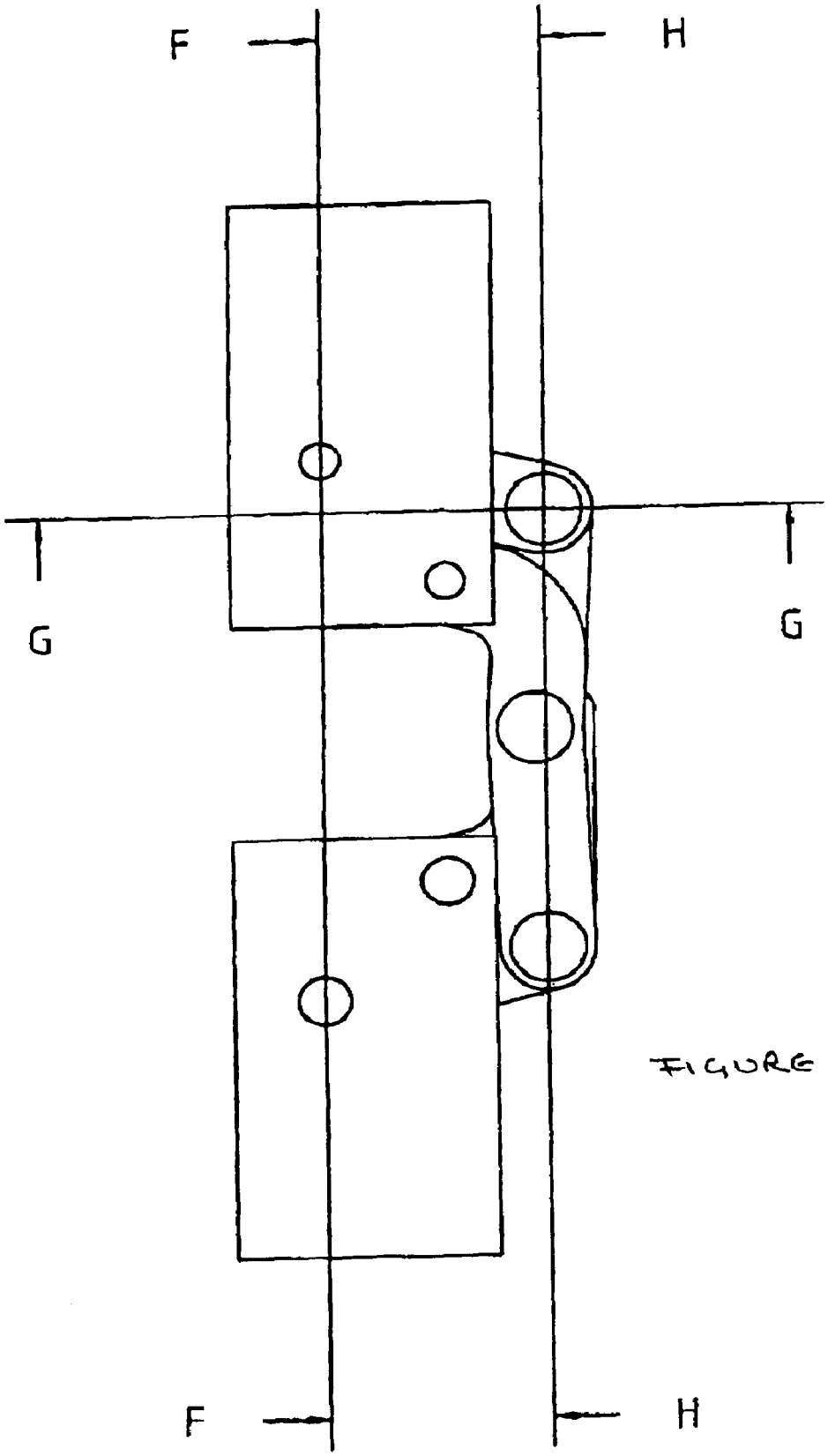
FIGS. 14*a*, 14*b*, 14*c* and 14*d* illustrate a cut-through of a hinge of the present invention.
Figure 14B:
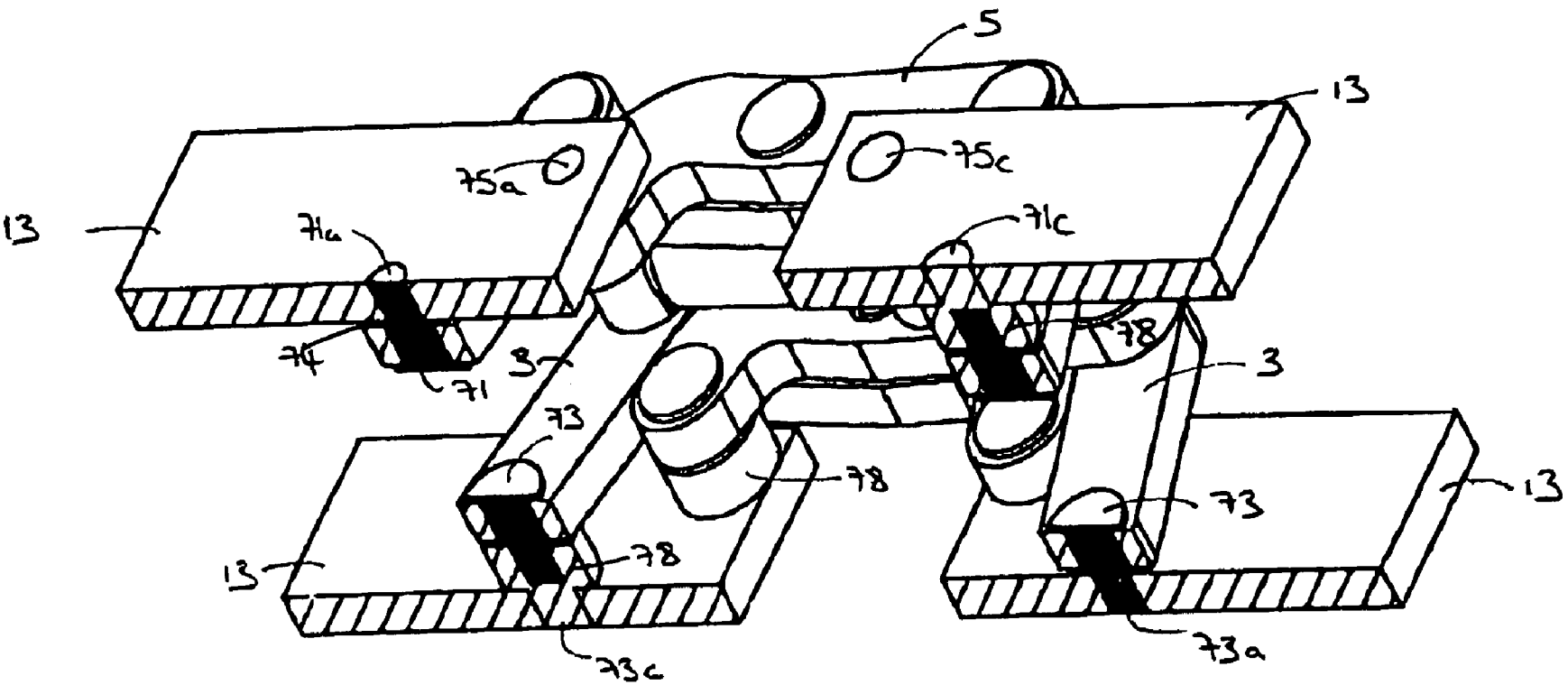

FIG. 14*b*, with reference to FIG. 14*a*, further illustrates the connection of the support arms 1, 3 to the connection blocks 13 using the pin arrangements illustrated in FIGS. 10*a* and 10*c*. The hinge 100 of the present invention illustrated in FIGS. 14*a* and 14*b* is in the open position.

Figure 14C:
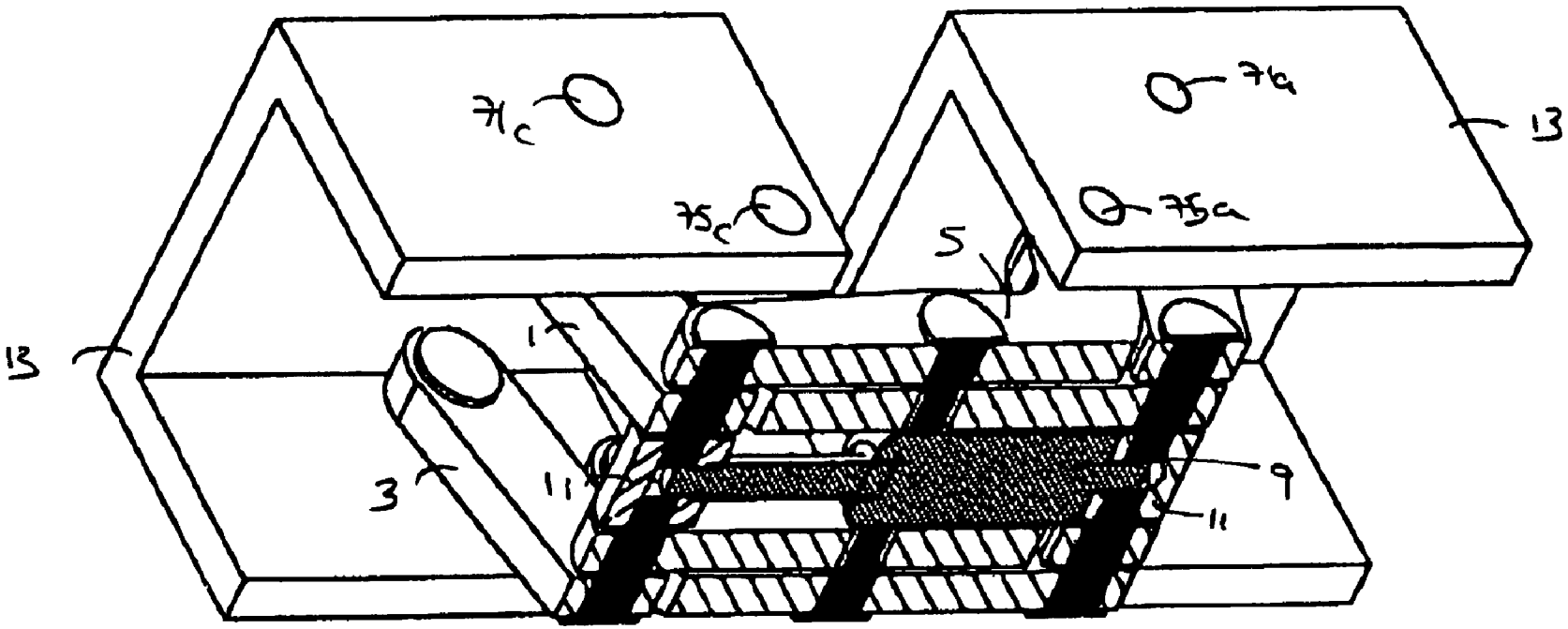
Figure 14D:
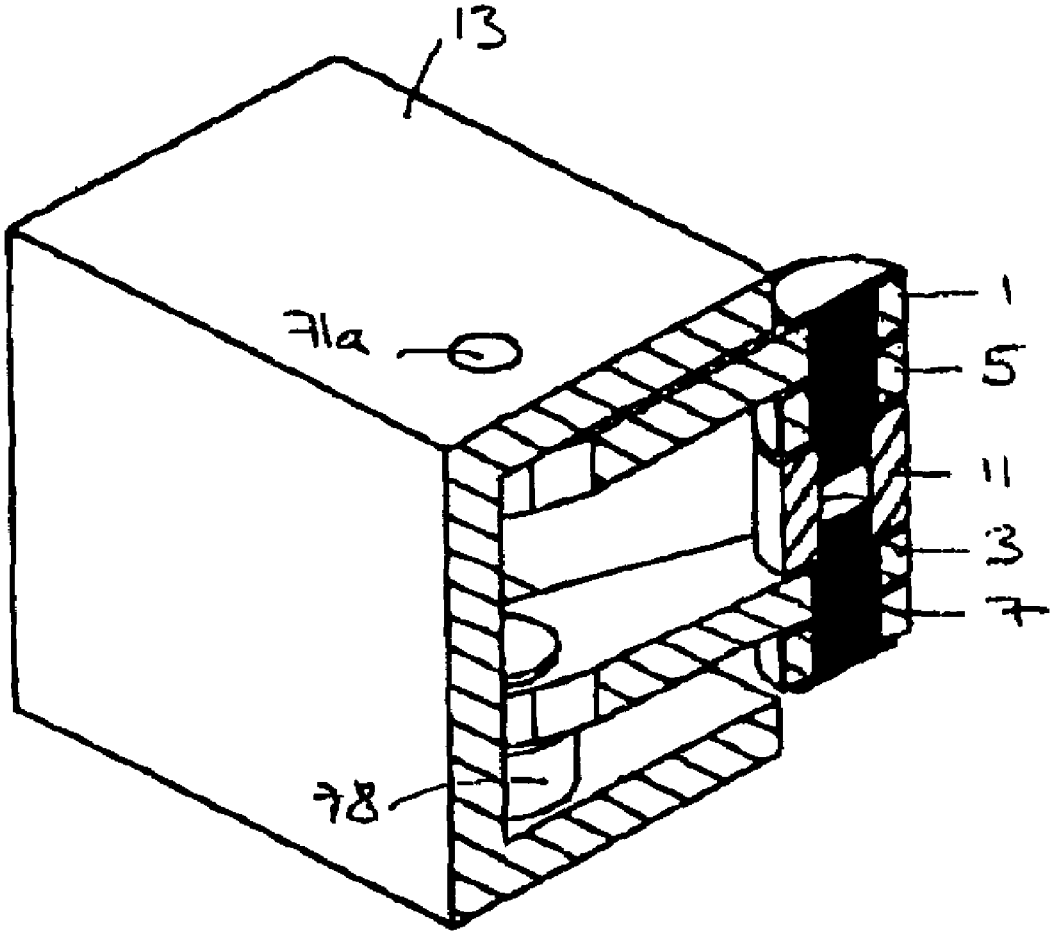

FIGS. 14*c* and 14*d* illustrate the connection of the support arms 1, 3 to the control arms 5, 7, and the connection of the control arms 5, 7 to the connectors 11. FIG. 14*c* further illustrated the connection of the gas strut 9 to the connectors 11

The ends 1*b*, 3*b* of the support arms 1, 3 may be pivotally connected to the ends 5*a*, 7*a* of the control arms 5, 7 and to the connectors 11 (or the gas strut 9 directly) via any suitable method of pivotal connection. Additionally, the control arms 5, 7 may be pivotally connected to the control arms 5, 7 at the point 5*c*, 7*c* via any suitable method of pivotal connection.

Figure 11A:
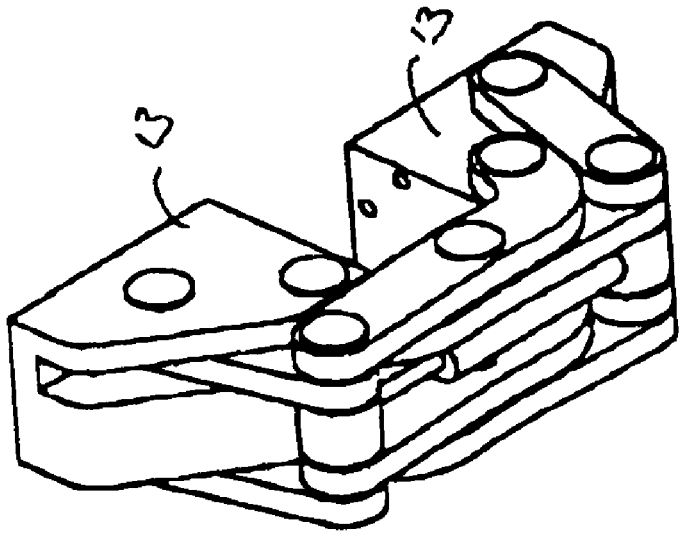
FIGS. 11*a* and 11*b* illustrate a several different shaped mounting blocks.
Figure 11B:
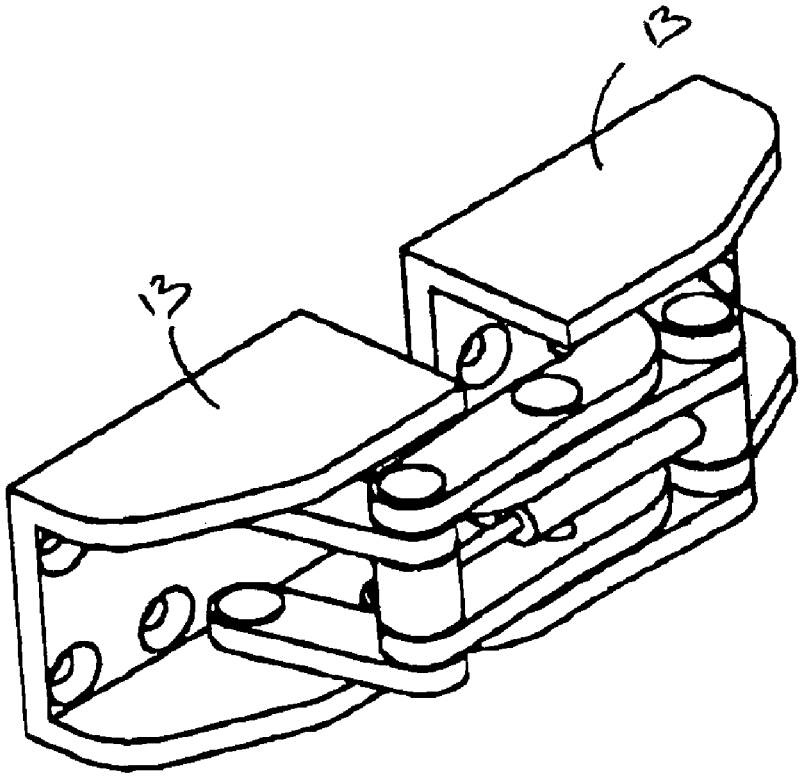

Although the mounting blocks 13 are illustrated in FIGS. 2, 3, 5, 6, 8 and 9 as being C shaped, the mounting blocks 13 are not limited to this shape and may be any shape which is practical to attach the mounting blocks 13 to a door or other body. FIGS. 11*a* and 11*b* illustrates different shaped mounting blocks 13, whilst FIGS. 12*a* to 12*c* illustrates how the mounting blocks 13 may be attached to a body, such as a door or a wall. Alternatively, the hinge 100 may be directly attached to the door and/or wall (or other bodies) without mounting blocks 13, if this is preferable.

FIGS. 12*a* to 12*c* illustrate the hinge 100 as being connected to the major surface 200, 300 of the two bodies respectively. However, the hinge 100 may also be attached to an edge 201, 301 of the two bodies respectively.

The hinge 100 of the present invention may be constructed from various different materials depending on the application of the hinge 100. For example, if the hinge 100 is to be used on a boat, then it is preferable that the hinge 100 is constructed from a material which is corrosion resistant. Some examples of materials are stainless steel, aluminium, and plastics.

The aforegoing description has been given by way of example only and it will be appreciated by a person skilled in the art that modifications can be made without departing from the scope of the present invention.

The invention claimed is:

1. A hinge comprising:

a first control arm having a first end and a second end, said first control arm connectable with a first object;

a second control arm having a first end and a second end, said second control arm connectable with a second object, said first control arm and said second control arm being pivotally connected to each other at a first point between said first and second ends of said first control arm and said first and second ends of said second control arm, the first object being rotatable relative to the second object;

a third control arm having a first end and a second end, said third control arm connectable with the first object; and a fourth control arm having a first end and a second end, said fourth control arm connectable with the second object, said third control arm and said fourth control arm being pivotally connected to each other at a fourth point between said first and second ends of said third control arm and said first and second ends of said fourth control arm, the first object being rotatable relative to the second object; and a gas strut having a first end and a second end, said first end of said gas strut being pivotally connected to said first control arm at either said first end of said first control arm or a second point between said first end of said first control arm and said first point, and said second end of said gas strut being pivotally connected to said second control arm at either said first end of said second control arm or a third point between said first end of said second control arm and said first point, and wherein said first end of said gas strut is pivotally connected to said third control arm at either said first end of said third control arm or a fifth point between said first end of said third control arm and said fourth point, and said second end of said gas strut is pivotally connected to said fourth control arm at either said first end of said fourth control arm or a sixth point between said first end of said fourth control arm and said fourth point, such that said gas strut is positioned between a first layer comprising said first and second control arms and a second layer, comprising said third and fourth control arms.

2. The hinge according to claim 1, further comprising:

a first support arm having a first end and a second end, said first end of said first support arm being pivotally connected to said first end of said first control arm; and a second support arm having a first end and a second end, said first end of said second support arm being pivotally connected to said first end of said second control arm.

3. The hinge according claim 2, wherein said second end of said first control arm and said second end of said first support arm are capable of being attached to a first member, and said second end of said second control arm and said second end of said second support arm are capable of being attached to a second member, said hinge enabling said first member to move in relation to said second member.

4. The hinge according claim 2, wherein said second end of said first control arm and said second end of said first support arm are capable of being attached to a first mounting block, and said second end of said second control arm and said second end of said second support arm are capable of being attached to a second mounting block, said first mounting block being capable of being attached to a first member and said second mounting block being capable of being attached to a second member, and said hinge enabling said first member to move in relation to said second member.

5. The hinge according to claim 1, further comprising:

a first support arm having a first end and a second end, said first end of first support arm being pivotally connected to said first end of said first control arm;

a second support arm having a first end and a second end, said first end of second support arm being pivotally connected to said first end of said second control arm;

a third support arm having a first end and a second end, said first end of said third support arm being pivotally connected to said first end of said third control arm; and a fourth support arm having a first end and a second end, said first end of said fourth support arm being pivotally connected to said first end of said fourth control arm; wherein said first end of said gas strut is pivotally connected to said third control arm at either said first end of said third control arm or a fifth point between said first end of said third control arm and said fourth point, and said second end of said gas strut is pivotally connected to said fourth control arm at either said first end of said fourth control arm or a sixth point between said first end of said fourth control arm and said fourth point, such that said gas strut is positioned between a first layer comprising said first and second control arms and a second layer, comprising said third and fourth control arms.

6. The hinge according to claim 5, wherein said gas strut is positioned within the working envelope of said hinge.

7. The hinge according claim 5, wherein said second end of said first control arm, said second end of said first support arm, said second end of said third control arm and said second end of said third support arm are capable of being attached to a first member, and said second end of said second control arm, said second end of said second support arm, said second end of said fourth control arm, said second end of said fourth support arm are capable of being attached to a second member, and said hinge enabling said first member to move in relation to said second member.

8. The hinge according claim 5, wherein said second end of said first control arm, said second end of said first support arm, said second end of said third control arm and said second end of said third support arm are capable of being attached to a first mounting block, and said second end of said second control arm, said second end of said second support arm, said second end of said fourth control arm and said second end of said fourth support arm are capable of being attached to a second mounting block, said first mounting block being capable of being attached to a first member and said second mounting block being capable of being attached to a second member, and said hinge enabling said first member to move in relation to said second member.

9. The hinge according to claim 1, wherein said gas strut comprises a cylinder and a piston, and said piston is recessed within said cylinder when said hinge is closed.

10. The hinge according to claim 1, wherein said gas strut comprises a cylinder and a piston, and said piston projects from said cylinder when said hinge is open.

11. The hinge according to claim 1, wherein said hinge is held closed by a locking means.

12. The hinge according to claim 1, wherein said hinge is held closed by a locking means, and wherein when said locking means is released, said gas strut opens said hinge.

13. The hinge according claim 1, wherein said second end of said first control arm is capable of being attached to a first member and said second end of said second control arm is capable of being attached to a second member, said hinge enabling said first member to move in relation to said second member.

14. The hinge according claim 1, wherein said second end of said first control arm is capable of being attached to a first mounting block and said second end of said second control arm is capable of being attached to a second mounting block, said first mounting block being capable of being attached to a first member and said second mounting block being capable of being attached to a second member, and said hinge enabling said first member to move in relation to said second member.

15. The hinge according claim 1, wherein said second end of said first control arm and said second end of said third control arm are capable of being attached to a first member, and said second end of said second control arm and said second end of said fourth control arm are capable of being attached to a second member, and said hinge enabling said first member to move in relation to said second member.

16. The hinge according claim 1, wherein said second end of said first control arm and said second end of said third control arm are capable of being attached to a mounting block, and said second end of said second control arm and said second end of said fourth control arm are capable of being attached to a second mounting block, said first mounting block being capable of being attached to a first member and said second mounting block being capable of being attached to a second member, and said hinge enabling said first member to move in relation to said second member.

17. The hinge according to claim 1, wherein said gas strut is a push-type gas strut.

18. The hinge according to claim 1, wherein said gas strut is a pull-type gas strut.

19. The hinge according to claim 1, wherein said hinge is held open by a locking means.

20. The hinge according to claim 1, wherein said hinge is held open by a locking means, and wherein when said locking means is released, said gas strut closes said hinge.

21. The hinge according to claim 1 or 2, wherein said first and second control arms are straight members.

22. The hinge according to claim 1 or 2, wherein said first and second control arms are hook shaped at said second end.

23. The hinge according to claim 1 or 5, wherein said first, second, third and fourth control arms are straight members.

24. The hinge according to claim 1 or 5, wherein said first, second, third and fourth control arms are hook shaped at said second end.

25. The hinge according claim 1 or 2, wherein said gas strut is connected to said first control arm by a first connection member and said second control arm by a second connection member.

26. The hinge according claim 1 or 5, wherein said gas strut is connected to said first and third control arms by a first connection member and said second and fourth control arms by a second connection member.

27. The hinge according claim 1 or 2, wherein said gas strut is connected to said first control arm by a first connection member and said second control arm by a second connection member and wherein said gas strut can be disconnected from said first and second connection members and said gas strut replaced by a new gas strut.

28. The hinge according claim 1 or 5, wherein said gas strut is connected to said first and third control arms by a first connection member and said second and fourth control arms by a second connection member and wherein said gas strut can be disconnected from said first and second connection members and said gas strut replaced by a new gas strut.

* * * * *